US005257424A

United States Patent [19]

Rogers

[11] Patent Number: 5,257,424

[45] Date of Patent: Nov. 2, 1993

[54] FOLDABLE BED

[76] Inventor: Walter C. Rogers, P.O. Box 685, Denton, N.C. 28239

[21] Appl. No.: 869,568

[22] Filed: Apr. 15, 1992

[51] Int. Cl.[5] ..... A47C 17/26; A47C 27/04

[52] U.S. Cl. ..... 5/13; 5/29; 5/36; 5/56; 5/250; 5/405

[58] Field of Search ..... 5/13, 28, 29, 36, 56, 5/249, 250, 465

[56] References Cited

U.S. PATENT DOCUMENTS

| | | | |
|---|---|---|---|
| 3,284,811 | 11/1966 | Rogers, Jr. | 5/13 |
| 3,516,096 | 6/1970 | Mikos | 5/13 |
| 4,004,305 | 1/1977 | Rubin | 5/465 |
| 4,104,745 | 8/1978 | Pacitti | 5/29 X |
| 4,200,941 | 5/1980 | Gill et al. | 5/13 |
| 4,235,205 | 3/1981 | Mikos | 5/13 |
| 4,381,570 | 5/1983 | Schneider | 5/29 X |
| 4,571,755 | 2/1986 | Stevens | 5/13 |
| 4,694,515 | 9/1987 | Rogers, Jr. | 5/13 |
| 4,768,253 | 9/1988 | Boyd et al. | 5/465 X |
| 4,780,918 | 11/1988 | Hartline | 5/29 X |
| 4,918,770 | 4/1990 | Hartline et al. | 5/13 |

FOREIGN PATENT DOCUMENTS

| | | | |
|---|---|---|---|
| 1094354 | 12/1967 | United Kingdom | 5/13 |

*Primary Examiner*—Michael F. Trettel
*Attorney, Agent, or Firm*—Bell, Seltzer, Park and Gibson

[57] ABSTRACT

A foldable bed comprising a frame including a body section, a cavity section, a seat section, and a foot section, each of which includes a pair of side rails, each of which are pivotally interconnected and which are movable between an unfolded position and a folded position, a mattress carried by the frame and movable therewith between the unfolded and folded positions, wherein in the folded position the mattress is folded upon itself to define an upper support surface, and interconnecting means for pivoting the frame sections between the unfolded position and the folded position, wherein in the unfolded position the body section, the cavity section, the seat section, and the foot section are serially and horizontally aligned, and the side rails of the sections are positioned along respective opposite sides of and generally below the mattress, and in the folded position, the body section is generally horizontal, the seat section overlies the body section, the cavity section extends substantially vertically between the body and seat sections, and the side rails of the seat section are disposed along the sides of the mattress and below the upper support surface is disclosed. The foldable bed also includes means for lowering the body section of the mattress during folding of the bed, a mattress comprising both collapsible and noncollapsible sections, biasing means which aid in the folding and unfolding of the bed, means for ensuring that the cavity section folds from the unfolded position simultaneously with the seat section folding about the cavity section, means for locking the bed into the folded position which comprises three sets of locking units, and an improved headrest mechanism.

47 Claims, 12 Drawing Sheets

FOLDABLE BED

FIELD OF THE INVENTION

This invention relates generally to foldable furniture, and relates specifically to an improved foldable bed suitable for attachment to a chair or sofa.

BACKGROUND OF THE INVENTION

Foldable beds, and particularly those folding beds which are stored within other furniture items, are an attractive option for consumers with restricted living space. Typically a foldable bed will fold upon itself either one or two times for easy storage, then will unfold into a bed for sleeping. The bed will generally include a mattress that is sufficiently flexible to fold upon itself and a frame which serves as both the supporting bed frame and as a restraining unit for the mattress in its folded position. The frame will include a body section pivotally attached at its ends to the ends of an intermediate cavity section, the opposite ends of which are attached to a seat section; these sections are serially aligned horizontally in the unfolded position, and are folded back upon one another such that the body section and seat section are substantially parallel to one another and are perpendicular to the cavity section. The frame is often mounted in an upholstered sofa or chair frame into which the bed frame and mattress are folded and stored when not in use; cushions are then placed upon the folded mattress for use of the unit as a sofa or chair.

To date, foldable beds have exhibited a number of shortcomings. One general area of dissatisfaction is the sleeping comfort of the bed. For storage purposes, it is desirable that the mattress fold into the thinnest package possible for storage. The need for a compactly folded mattress is most apparent if the mattress and frame are attached to a sofa or chair, since the mattress and frame must fit within the walls of the sofa or chair, which well may have style or ergonomic restrictions. Thick, firm mattresses that would provide suitable sleeping comfort are too bulky to be folded into the compact size required by many sofa or chair styles; in particular, transitional and contemporary styles often require either a low seat height or an "off-the-floor" front profile. Present sofas have addressed the size constraint by using a mattress that is either thin and easily folded into a thin unit, soft and easily crushed into a thin unit, or a combination of each. The result of such compromises is generally an unsatisfactory sleeping surface.

Another problem is the seating comfort of the chair or sofa, which depends not only on the firmness of the seat cushions and the mattress, but also on the folded configuration of the bed frame within the storage chamber of the sofa. The frame supports the lower surface of the mattress from below in the unfolded position; as the bed is folded into the folded position, the portion of the frame that supported the seat section of the bed in the unfolded position inverts to rest on the top edge of the mattress in the folded position. Cushions for a chair or sofa then lie upon the mattress and on the side rail of the seat section of the bed frame. The presence of this side rail beneath the cushion adversely affects the seating comfort of the cushion. As an occupant sits on the cushion, the cushion edge directly over the side rail tends to "ride" the side rail, and as a result the cushion supports the occupant unevenly. Attempts to address this deficiency have included the incorporation of a curved portion in the seat section side rail which bends out of the plane of the upper surface of the mattress, but this has not been entirely successful at providing a uniform, comfortable feel within the seat.

There has also been some dissatisfaction with the operation of the folding mechanism in moving from the folded position to the unfolded position and back. In particular, the smoothness with which the mechanism folds has been criticized, as has the ease of locking the mechanism into and unlocking it from the folded position after the folded bed has been removed from its storage chamber within a sofa. The folding of the bed is affected by the sequence in which the mechanism folds from the unfolded position. Ideally, during folding from the unfolded position to the folded position the seat section begins to pivot about the cavity section essentially simultaneously with any pivoting of the cavity section about the body section. However, linkages that control the folding of the frame do not time the folding of the frame to achieve this folding sequence. Instead, often the cavity section will begin to fold first; consequently, the seat section pivots slightly about the cavity section away from the folded position (i.e., to a position slightly beyond horizontal) before it rotates back toward the folded position. This reverse motion causes a undesirable "catching" jolt that is transmitted to the operator during opening, and, more importantly, can cause the unfolded sofa to fold prematurely into the sofa storage chamber.

The unlocking of the bed from the folded position in many current models is also operationally unsatisfactory. The bed must be locked into the folded position so that it does not unfold while stored within a sofa or closet. Most commonly used is a two-unit "squeeze" locking configuration of linkages which employs a supporting leg as a lever to create within the folding mechanism two substantially "on-center" alignments of three interconnected pivots as the leg folds completely into the folded position. One of the sets of pivots locks the seat section in its folded position relative to the cavity section; the other locks the cavity section into its folded position relative to the body section. See, e.g., U.S. Pat. No. 4,905,328 to Pokorny. Locking mechanisms of this type compress the mattress into the folded position; accordingly, they must be able to withstand the relatively high forces exerted by the compressed mattress to avoid opening prematurely. Consequently, these linkages are generally difficult to unlock, often requiring the operator to jerk vigorously on the leg mechanism to unlock the bed.

Many foldable beds have a head section pivotally connected to the body section at the end thereof opposite the cavity section which folds into a generally vertical position in the folded position. In the unfolded position, the head section is generally movable between a stationary horizontal position aligned with the other frame sections and a releasably locked inclined position which permits the user to read or watch television comfortably while lying on the bed. There are a number of mechanisms in current use which control the inclining and reclining of the head section in the unfolded position, virtually all of which use a mechanism which includes a slotted member along which a "bow-tie" shaped locking member slides and pivots to lock and unlock the headrest into and from the inclined position. This sliding mechanism is somewhat difficult to manufacture consistently and will at times malfunction after repeated use; thus its replacement with a mechanism which operates comparably is desirable.

Accordingly, what is needed is a foldable bed which is comfortable for sleeping and sitting, easily and smoothly operated from the folded and unfolded position, and easily manufactured.

SUMMARY OF THE INVENTION

In view of the foregoing, it is an object of the present invention to provide a foldable bed which furnishes a comfortable sleeping surface in an unfolded position and which folds into a compact unit for storage, particularly within a sofa or chair.

It is another object of the present invention to provide a bed frame foldable within a sofa or chair which in the folded position provides a mattress surface upon which all of the seat cushions of the sofa or chair can be compressed under the weight of an occupant without the underlying frame interfering with the seating comfort of the cushions.

It is also an object of the present invention to provide a foldable bed which unfolds smoothly from the folded position to the unfolded position, and in particular moves from the locked folded position smoothly and without undue effort.

It is a further object of the invention to provide a foldable bed which folds smoothly from the unfolded position into the folded position, and in particular moves from the unfolded position in such a way that the seat section pivots about the cavity section toward the folded position simultaneous with the pivotal movement of the cavity section about the body section, a sequence which prevents any reverse rotation of the seat section about the cavity section away from the unfolded position.

It is an additional object of the present invention to provide a headrest for a foldable bed that is more easily and consistently manufactured and that operates more smoothly than those currently known in the art.

These and other objects are satisfied by the present invention, which includes as a first aspect a foldable bed movable between an unfolded extended and generally horizontal position and a folded position, which comprises a frame comprising a body section, an intermediate cavity section, a seat section, and a foot section, with each section comprising a pair of laterally spaced apart side rails, means pivotally interconnecting each of the frame sections to at least one adjacent section for pivotal movement between the unfolded position and the folded position, and a mattress carried by the frame and movable therewith between the unfolded and folded positions of the frame such that in the folded position the mattress is folded upon itself. The interconnecting means are constructed and arranged such that in the unfolded position the body section, the cavity section, the seat section, and the foot section are serially and horizontally aligned, and the side rails of the sections are positioned along respective opposite sides of and generally below the mattress, and in the folded position, the body section is generally horizontal, the seat section overlies the body section, the cavity section extends substantially vertically between the body and seat sections, and the side rails of the seat section are disposed along the sides of the mattress and below the upper support surface of the mattress. In one embodiment the foot section is disposed substantially vertically in the folded position such that is fits within the back section of the sofa. In another embodiment the foot section is disposed substantially horizontally so that the side rails of the foot section are disposed beside the mattress.

A second aspect of the present invention is a mattress foldable into a folded and an unfolded position comprising at least one collapsible section and a noncollapsible section pivotally interconnected at their ends. In the unfolded position, the collapsible sections and the noncollapsible section are horizontally and serially aligned and of a uniform depth; in the folded position, at least one of the collapsible sections is collapsed in the depth dimension and overlies the noncollapsible section. In one embodiment, the body section of the mattress is noncollapsible, and the head, cavity, seat, and foot sections of the mattress are collapsible.

A third aspect of the present invention is a foldable bed which includes means for supporting the body section of the mattress for movement between a raised position, wherein the lower surface of body section of the mattress is in horizontal alignment with the bed frame when the bed is in the unfolded position, and a lowered position, wherein the body section of the mattress is disposed below the raised position when the bed is in the folded position, and further includes means for causing the body section to move between the raised and lowered positions when the bed is moved between the unfolded and folded positions. In a preferred embodiment, the means for raising and lowering the body section is operably interconnected with the cavity section of the frame so that pivoting of the cavity section from the unfolded position to the folded position causes the body section of the mattress to be lowered.

A fourth aspect of the invention is a foldable bed which includes means for causing the cavity section and the seat section of the frame to assume a first intermediate position between the unfolded position and a second generally vertical intermediate position, and means for biasing the cavity section and the seat section of the frame toward the first intermediate position when the bed is in either the unfolded position or the generally vertical intermediate position. In one embodiment, the biasing means comprises a torsion bar attached to the cavity section and the body section of the frame.

A fifth aspect of the invention is a foldable bed which includes means for causing the seat section to pivot about the cavity section toward the folded position essentially simultaneously with the pivoting of the cavity section about the body section toward the folded position. This prevents reverse pivotal movement of the seat section about the cavity section and thereby leads to smoother folding of the bed.

A sixth aspect of the invention is a foldable bed which includes a leg member pivotally interconnected to the seat section which is movable between a folded condition and an unfolded condition, a first locking means for restraining pivotal movement of the seat section about the cavity section responsive to the movement of the leg member, a second locking means for restraining pivotal movement of the seat section about the cavity section operatively connected to the first locking means, and a third locking means for restraining pivotal movement of the cavity section about the body section operatively connected to the second locking means. In the folded position, movement of the leg member into the folded condition causes the first and second locking means to restrain the pivotal movement of the seat section about the cavity section, and the third locking means to restrain the pivotal movement of the cavity section about the cavity section. In a preferred embodiment, the first and second locking means each comprise a set of three substantially aligned "on-center" pivots within the mechanism that folds the bed frame.

A seventh aspect of the invention is a foldable bed which includes a head section which further comprises linkage means mounting the head section for movement between a horizontal position and an inclined position when the bed is in the unfolded position, and for releasably locking the head section in the inclined position. The headrest linkage comprises a mounting linkage connected to the frame, a locking member pivotally connected to the mounting linkage, a latching link pivotally connected to the mounting linkage, and means for rotating the latching link about its pivot on the mounting means. The latching link includes a C-shaped portion with a hooking arm on its end opposite its pivotal connection and a retaining edge facing to the hooking arm, and a convex arcuate camming edge disposed in the same direction as the hooking arm. The hooking arm, camming edge, and retaining edge pivot in response to the inclination and lowering of the head section to rotate the locking link between a locking orientation and a non-locking orientation.

DETAILED DESCRIPTION OF THE INVENTION

The present invention is directed to an improved foldable bed which may be attached to and stored within a chair or sofa. The invention addresses and rectifies many of the problems that plague current sleeper sofa models. The present invention will now be described more particularly hereinafter with reference to the accompanying drawings, in which present embodiments of the invention are shown. The invention can, however, be embodied in many different forms and should not be limited to the embodiments set forth herein; rather, this embodiment is provided so that this disclosure will be thorough and complete, and will fully convey the scope of the invention to those skilled in the art.

Figure 1:
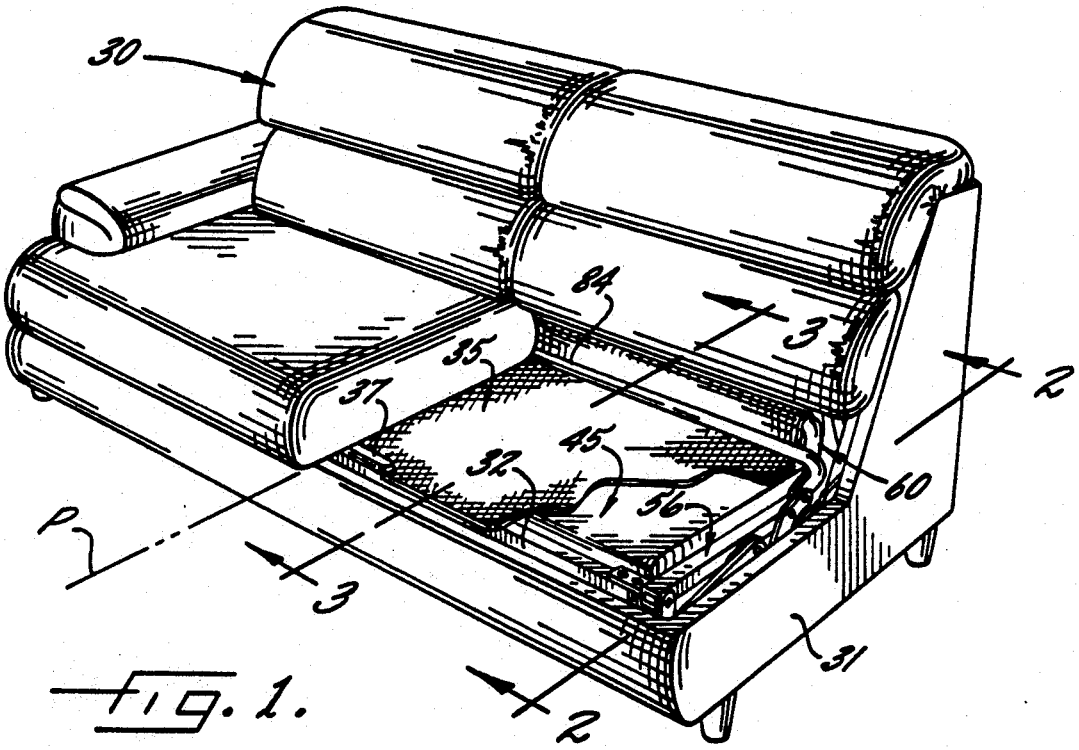
FIG. 1 is a perspective cutaway view of a foldable bed stored within a sofa.

A current embodiment of the invention and its features is shown in FIGS. 1–23. FIG. 1 shows a sleeper sofa model 30 which has folded within its central chamber a foldable bed 50, although it will be appreciated by those skilled in this art that the foldable bed can be attached to and foldable within other furniture items, such as a chair, attached to and foldable within some stationary structure, such as a house or apartment wall or closet, or free-standing. The sofa shown in FIGS. 1–3 includes a sofa frame 31 surrounding a central chamber 32 within which the foldable bed 50 is stored. The chamber 32 must be sufficient in size for the folded bed to fit within. A mounting unit 40 is fixed to the inner side walls of the sofa 30 and is pivotally attached to a frame 56 of the foldable bed 50 for movement of the bed into and out of the chamber 32. Any mounting assembly configuration known to those skilled in this art is suitable for folding a foldable bed within a furniture storage chamber can be used with this folding bed.

The bed 50 has a plane of symmetry best illustrated in FIG. 1 by P as the plane created by the inner edges of the cushions on the upright portion of the sofa and by the side wall of the seat cushion shown. For simplicity and clarity, only the components on one side of the plane of symmetry will be described; unless otherwise noted, it is to be understood that the components across the plane of symmetry are the mirror images of those described.

The bed 50, best seen in FIGS. 4–7, comprises a mattress 45, a frame 56 which supports the mattress 45, and an interconnecting assembly 57 which causes the frame 56 to fold and unfold in a predetermined fashion. The frame 56 comprises a foot section 60, a seat section 90 pivotally interconnected at one end to the foot section 60 and pivotally connected to a seat section leg assembly 80, a cavity section 110 pivotally interconnected to the seat section 90 on the end thereof opposite the foot section 60, a body section 130 pivotally interconnected to the cavity section 110 on the end thereof opposite the seat section 90, further pivotally interconnected to the mounting means 40, and additionally pivotally interconnected to a body section leg 124, and a head section 200 pivotally interconnected to the body section 130 on the end thereof opposite the cavity section 130 and further pivotally interconnected to the mounting means 40. The interconnecting assembly 57 comprises a foot section interconnection unit 70 pivotally interconnected to the foot section 60 and to the foot section leg assembly 80, a seat section interconnecting assembly 100 pivotally interconnected to the seat section 90 and the cavity section 110, and a cavity section interconnecting assembly 120 pivotally interconnected to the cavity section 110 and slidably and pivotally interconnected to the body section 130.

The foot section 60 (FIG. 7) comprises a tubular side rail 61, a tubular foot section end piece 62 fixed to the side rail 61 on the end thereof opposite the pivotal connection with the seat section 90 which extends the width of the frame 56, and a foot section cross bar 63 fixed at the seat end of the foot section 60 which extends to the corresponding side rail of side rail 61 on the opposite side of the bed.

Figures 6, 7:
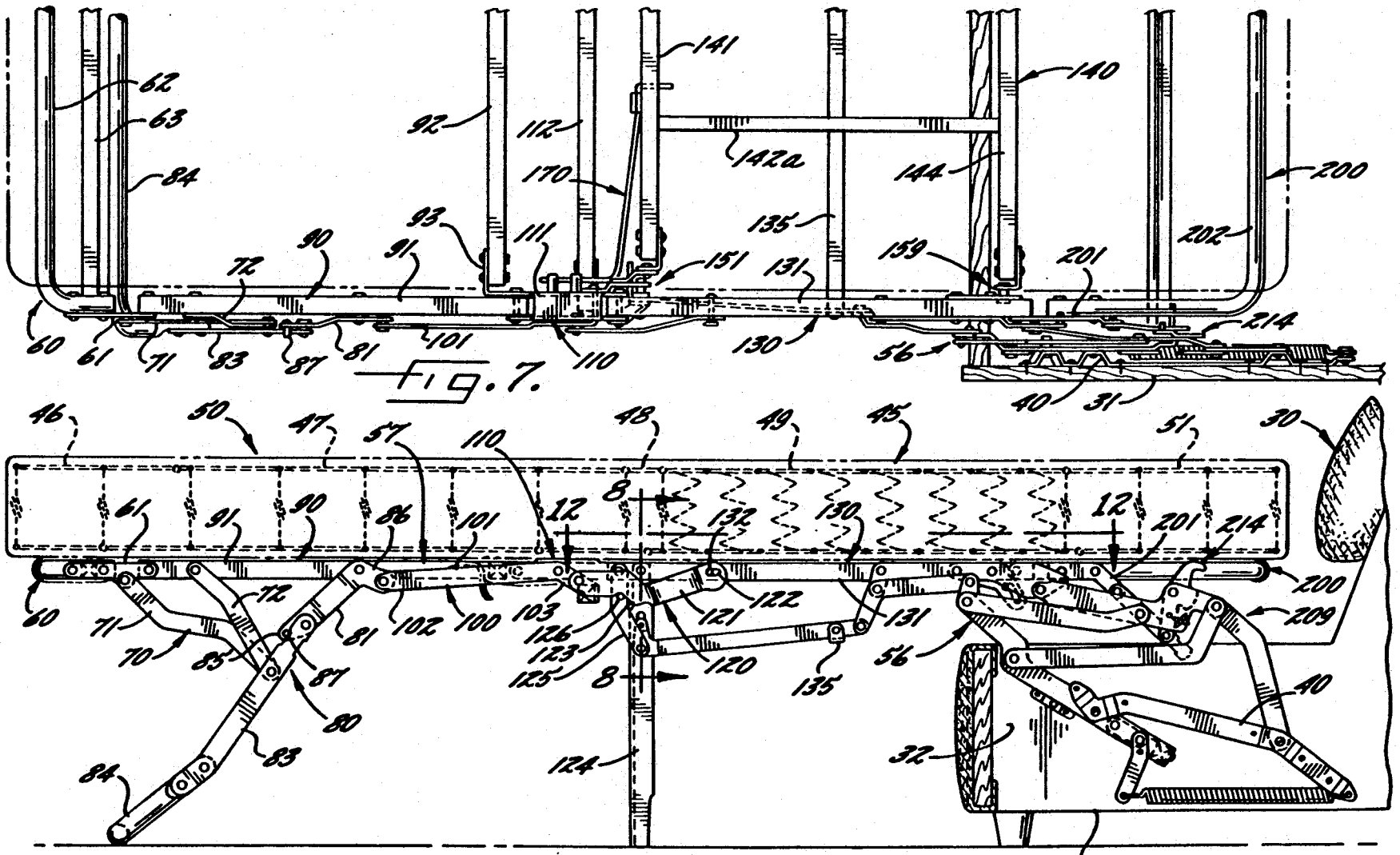
FIG. 6 is a side elevational view of the unfolded position of the bed.
FIG. 7 is a top view of the bed frame.
Figure 9:
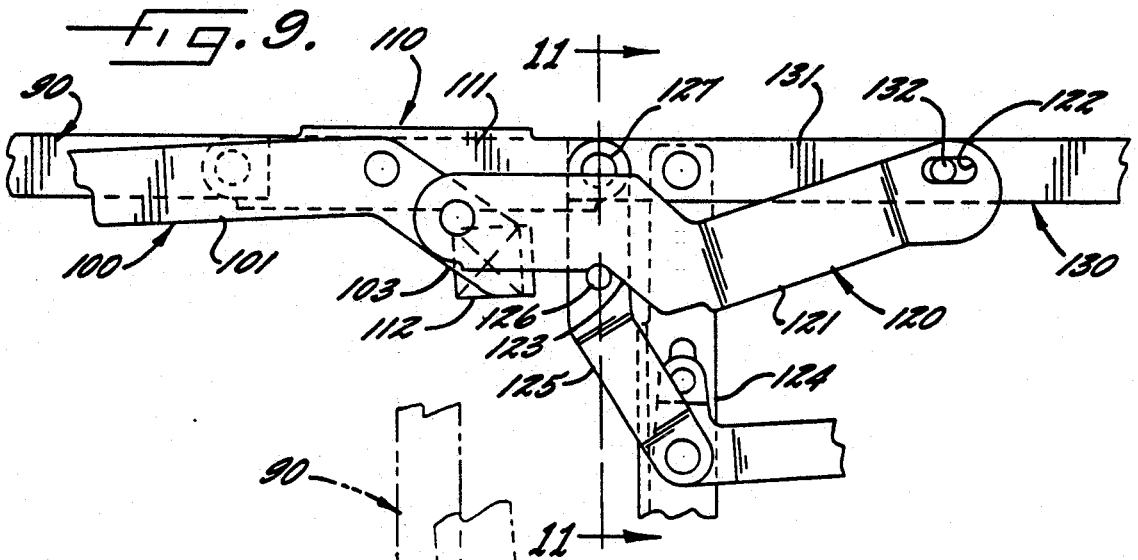
FIG. 9 is a side elevation enlargement of the cavity drawing member in the unfolded position.
Figure 10:
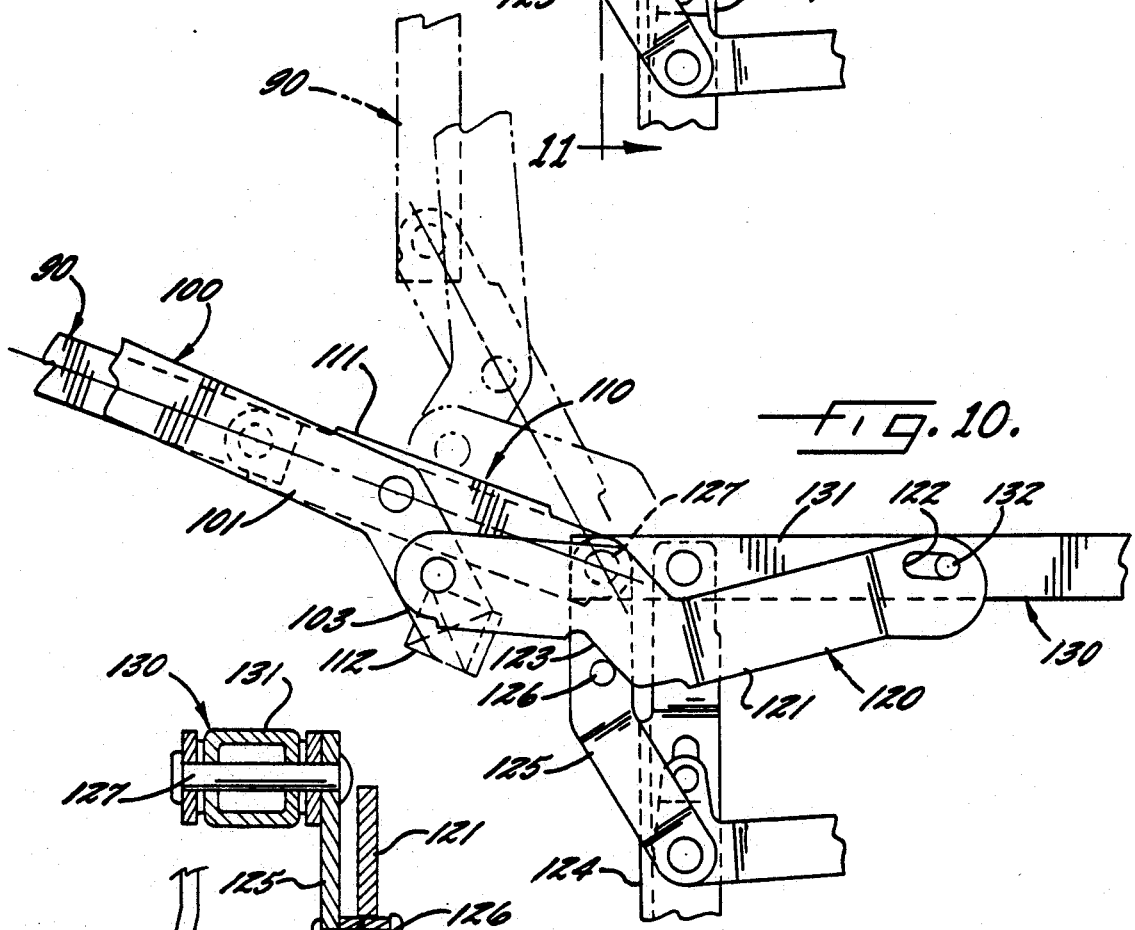
FIG. 10 is a side elevational enlargement of the cavity drawing member shown as its camming edge slides along a stationary stop pin.
Figure 11:
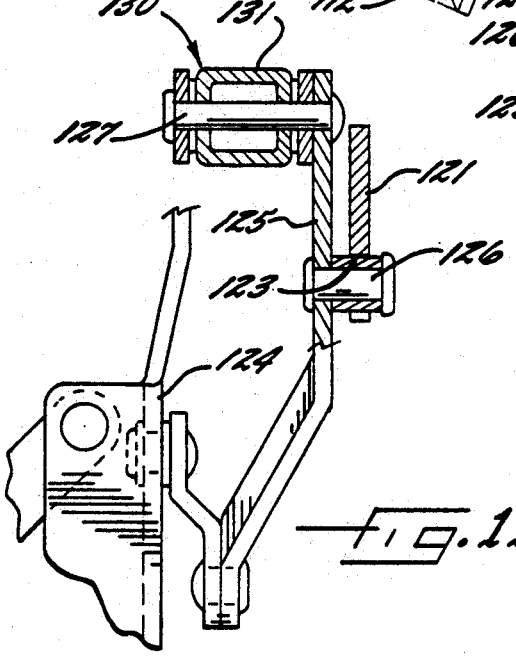
FIG. 11 is a cross-sectional view taken along line 11—11 of FIG. 9 showing the spatial relationship of the cavity drawing member to the front lowering unit.

The pivotal rotation of the foot section 60 is controlled by the foot section interconnecting assembly 70, seen most clearly in FIG. 6, which comprises a foot section control link 71, a foot section support link 72, and the seat section leg assembly 80. Foot section control link 71 is pivotally interconnected to the side rail 61 of the foot section and to a leg member 83. The foot section support link 72 is pivotally interconnected to the seat section 90 near the end thereof adjacent the foot section 60 and is pivotally interconnected to the leg member 83 through the same pivotal interconnection as the foot section control link 71. The seat section leg assembly 80 comprises an L-shaped seat pivot link 81 pivotally interconnected to a leg member unit 82, which comprises the leg member 83 and a leg extension 84 fixed to the leg member 83 on the end thereof opposite the seat pivot link 81. The seat pivot link 81 is pivotally interconnected at its vertex to a seat section side rail 91 and has a longer arm 85 and a shorter arm 86; the longer arm 85 is pivotally interconnected on its end to the leg member 83. The longer arm 85 also includes a pin 87 located on the longer arm 85 on the end thereof further endward than the pivotal interconnection of the longer arm 85 with the leg member 83. The pin 87 prevents rotation of the leg member unit 82 about the longer arm 85 away from the shorter arm 86 of the seat pivot link 81 beyond a predetermined position, which in this embodiment is a position approximately parallel to the longer arm 85.

The seat section 90 (FIG. 7) comprises a side rail 91 of square cross-section pivotally interconnected to foot section side rail 61 on the end thereof opposite the foot section end piece 62, and a seat section cross bar 92, which is fixed to the side bar 91 at the end thereof nearest the cavity section with a flange 93, and which extends to the corresponding side rail on the opposite side of the bed.

Pivotal rotation of the seat section 90 is controlled by the seat interconnection unit 100, best seen in FIG. 6, which comprises the shorter arm 86 of the seat pivot link 81 and a cavity pivot link 101. The cavity pivot link 101 is L-shaped and is pivotally interconnected to the cavity section side rail 111 at its vertex. The cavity pivot link 101 has a longer arm 102, which is pivotally interconnected to the shorter arm 86 of the seat pivot link 81, and a shorter arm 103, which is pivotally interconnected to the cavity interconnection unit 120.

Cavity section 110 (FIG. 7) comprises a side rail 111 pivotally interconnected to the seat section side rail 91 on the end thereof opposite the foot section 60, and cavity cross-bar 112, which is fixed to side rail 111 intermediate of the pivotal attachments of the cavity section to the body and seat sections and extends to a fixed attachment on the corresponding side rail on the opposite side of the bed. The cavity section 110 further comprises two cavity torsion bar restraints **113*a*, 113*b*, each of which has an aperture 114*a*, 114*b* for receiving torsion bar 170, which are fixed to the inner surface of side rail 111**.

Pivotal movement of the cavity section 110 about the body section 130 is controlled by the cavity interconnecting unit 120, best seen in FIG. 6, which comprises the shorter arm 102 of the cavity pivot member 101 and a cavity drawing member 121. The cavity drawing member 121 is pivotally interconnected to the end of the shorter arm 102 and is pivotally and slidably interconnected through a slot 122 to a retaining pin 132 fixed to the exterior lateral surface of the body section side rail 131. The cavity drawing member 121 includes a camming edge 123 which engage and moves slidably on a pin 126; the pin 126 is fixed to a leg folding link 125 attached to the body section leg 124 and to the pivotal interconnection 127 between the cavity section side rail 111 and the body section side rail 131.

The body section 130 (FIG. 7) comprises a side rail 131, a body section cross strap 135, and a body section support assembly 140. The side rail 131 is pivotally interconnected to the cavity section side rail 111 on the end thereof opposite the seat section. Body section cross strap 135 is fixed to the mounting unit 40 intermediate its ends and extends to a fixed attachment on the corresponding mounting unit on the opposite side of the frame. The body section leg 124 (FIG. 6) is pivotally interconnected to the side rail 131 adjacent its pivotal interconnection 127 with the cavity section side rail 111. Mounting unit 40 is also pivotally interconnected to the side rail 131 at its pivotal interconnection with the cavity section side rail 111, a position intermediate the ends of side rail 131, and at the end adjacent the head section 200.

Figure 12:
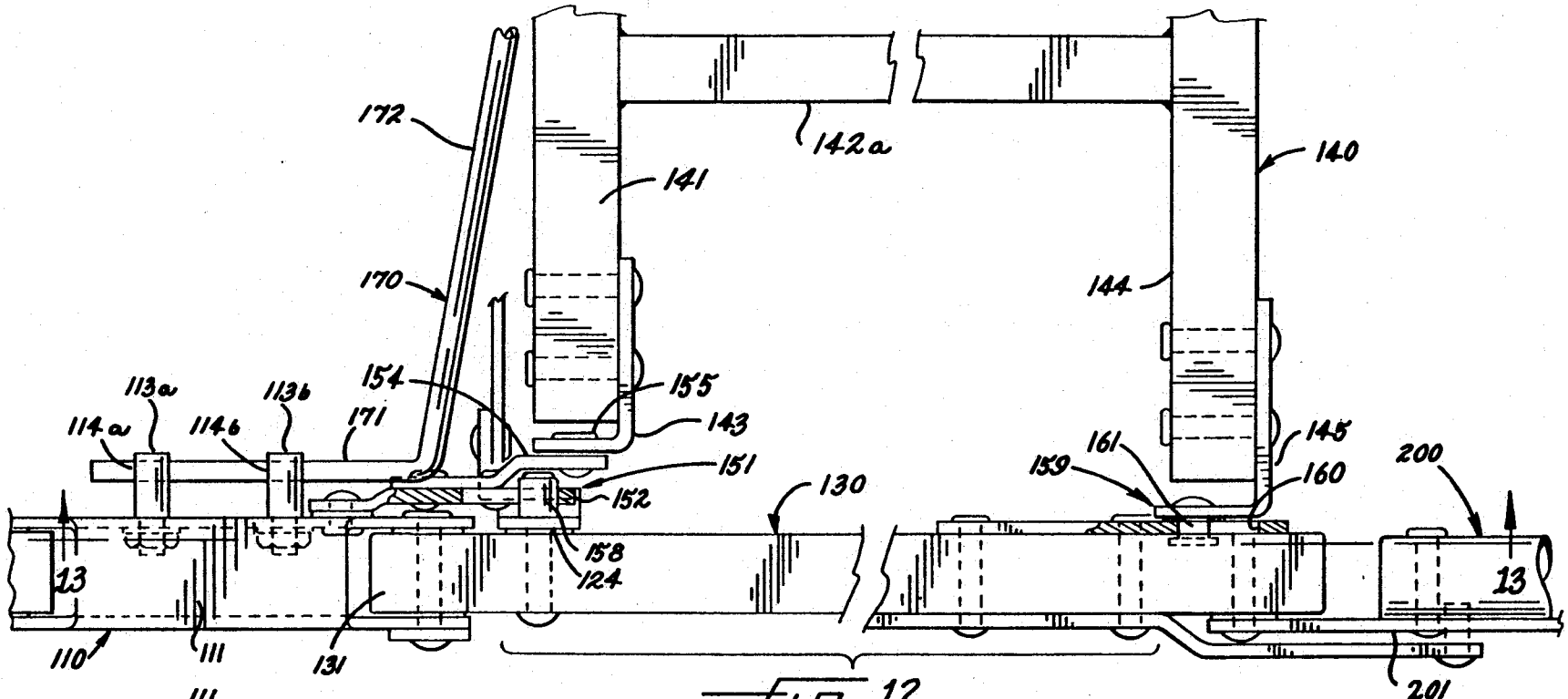
FIG. 12 is a plan view taken along line 12—12 of FIG. 6 showing the body section lowering unit.
Figure 16:
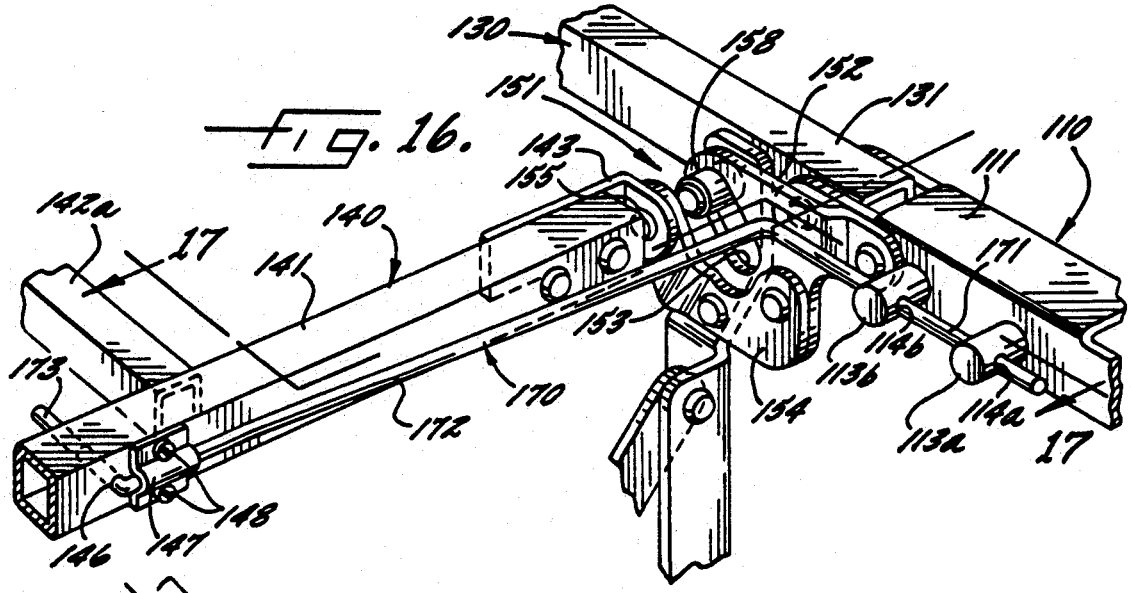
FIG. 16 is a perspective view of the torsion bar.

The body section support assembly 140, best seen in FIG. 12, comprises a flange 143 pivotally interconnected with the front lowering unit 151, a seat section front cross bar 141, which is fixed to the flange 143 and which extends to a fixed attachment at the corresponding flange on the opposite side of the frame, a flange 145 slidably connected to a rear lowering unit 159 by pin 161, a seat section rear cross bar 144, which is fixed to the flange 145 and which extends to fixedly attach on the corresponding flange on the opposite side of the frame, and three support braces 142*a*, 142*b*, and 142*c* (142*b* and 142*c* not shown) which are fixed at one end to the cross bar 141 and at the opposite end to cross bar 144. Cross bar 141 includes an aperture 146 which oriented substantially parallel with the side rail 131 and is configured to receive torsion bar 170 (FIG. 16). Sleeve 147 is attached to the cavity side of cross bar 141 through bolts 148, 148*a* intermediate the aperture 146 and a front lowering unit 151 and is configured to receive and retain torsion bar 170.

Torsion bar 170 (FIGS. 16) comprises a cavity segment 171, a torsion segment 172, and a body segment 173. The cavity segment 171 fits within the apertures 114, 114*a* of the restraints 113, 113*a*. The torsion segment 172 is fixed substantially perpendicular to the cavity segment 171 at the end thereof adjacent the body section side rail 131 such that it extends adjacent and substantially parallel to the cross bar 141 of the body section support assembly 140. The body segment 173 is fixed to the torsion segment 172 on the end thereof opposite the cavity segment 171 substantially perpendicularly to the torsion segment 172 and preferably extends from the torsion segment 172 so that the angle formed by the body segment and the cavity segment when viewed along the longitudinal axis of the torsion segment in a torsion-free condition is between about 110 and 160 degrees.

Figures 5, 8:
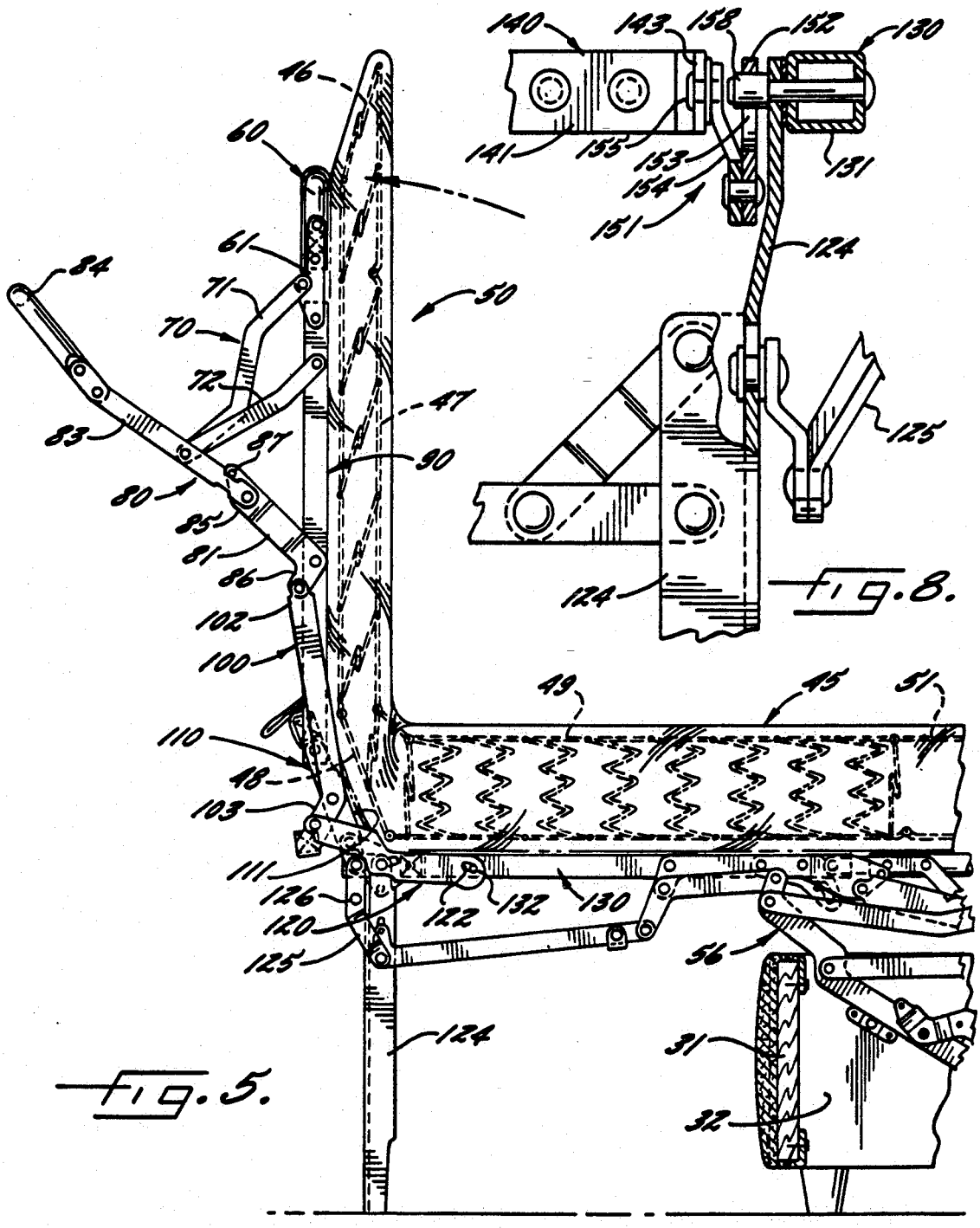
FIG. 5 is a side elevational view of the partially unfolded bed.
FIG. 8 is a cross-sectional view taken along line 8—8 of FIG. 6 showing the front lowering unit.

The body section lowering unit 150 (FIGS. 8, 12–15) is included in this embodiment for movement of the body section support assembly 140 between a raised position in horizontal alignment with the frame 56 when the bed 50 is in the unfolded position and a lowered position below the raised position when the bed 50 is in the folded position. The lowering mechanism permits the furniture designer to consider designs with lower seat heights. In addition, the lowering mechanism facilitates the use of a thicker mattress, and also reduces the stress on any locking mechanism which squeezably locks the bed and mattress into the folded position. Although any means suitable for raising and lowering the body section can be used, in this embodiment the lowering unit 150 comprises the front lowering unit 151 and the rear lowering member 159. The front lowering unit 151 comprises a slotted member 152 and a support member 154. The slotted member 152 is pivotally interconnected to the interior surface of the cavity section side rail 111 and pivotally and slidably interconnected to the interior surface of the body section side rail 131 through the slot 153 by a pin 158 which is fixed to the side rail 131 (FIG. 8). The support member 154 is fixed to the slotted member 152 and is pivotally interconnected at 155 to the flange 143 of the body section support assembly 140. The rear lowering member 159 includes an arcuate slot 160 which receives a pin 161 to interconnect the rear lowering member 159 with the flange 145 of the body section support assembly 140.

Movement of the body section 130 is controlled by mounting unit 40 (FIG. 4), which can be any mounting linkage or device known to those skilled in this art for folding the body section leg 124 to a horizontal position and for moving the body section 130 into the chamber 32 of the sofa 30. In this embodiment the mounting unit 40 is pivotally interconnected to the body section 130 at either end of the body section side rail 131, and at an intermediate location on the side rail 131.

The head section 200 comprises a side rail 201 pivotally interconnected to the body section side rail 131 on the end thereof opposite the cavity section 110, and a head end member 202 fixed to the side rail 201 on the end thereof opposite the body section 130 which extends to attach fixedly to the corresponding side rail on the opposite side of the frame.

Pivotal movement of the head section 200 about the body section 130 as the bed 50 is folded into and out of the storage chamber 32 of the sofa 30 is controlled by the mounting unit 40, but could be carried out by any means known to those skilled in this art to rotate the head section 200 to a substantially vertical position as the folded bed 50 is moved within the storage chamber 32. The head section 200 can pivot about the body section 130 when the couch is in the unfolded position to a releasably locked inclined position suitable for television viewing or reading. This pivotal movement is controlled by the headrest mechanism 209 (FIGS. 19–23), which is pivotally mounted to the mounting unit 40. The headrest mechanism comprises a bow-tie-shaped locking member 211, a latching link 214, and means for rotating the latching link 214 about the locking member 211, which in this embodiment comprises a driving link 210. The locking member 211 is pivotally connected through its center 211*a* to the mounting unit 40 and has a pair of concave arcuate edges 212*a*, 212*b* on opposing sides of this pivot and a pair of notched edges 213*a*, 213*b* on the opposing sides of the pivot perpendicular to the concave edges 212*a*, 212*b*. The latching link 214 is centrally pivotally interconnected at 214*a* to the mounting means 40 and comprises on one end a drive arm 215 pivotally interconnected to the driving link 210, and at the other end an arcuate hooking arm 218. Facing the hooking arm 218 is a retaining lobe 217 which blends into a camming surface 216 opposite the pivot 214*a*.

Figure 3:
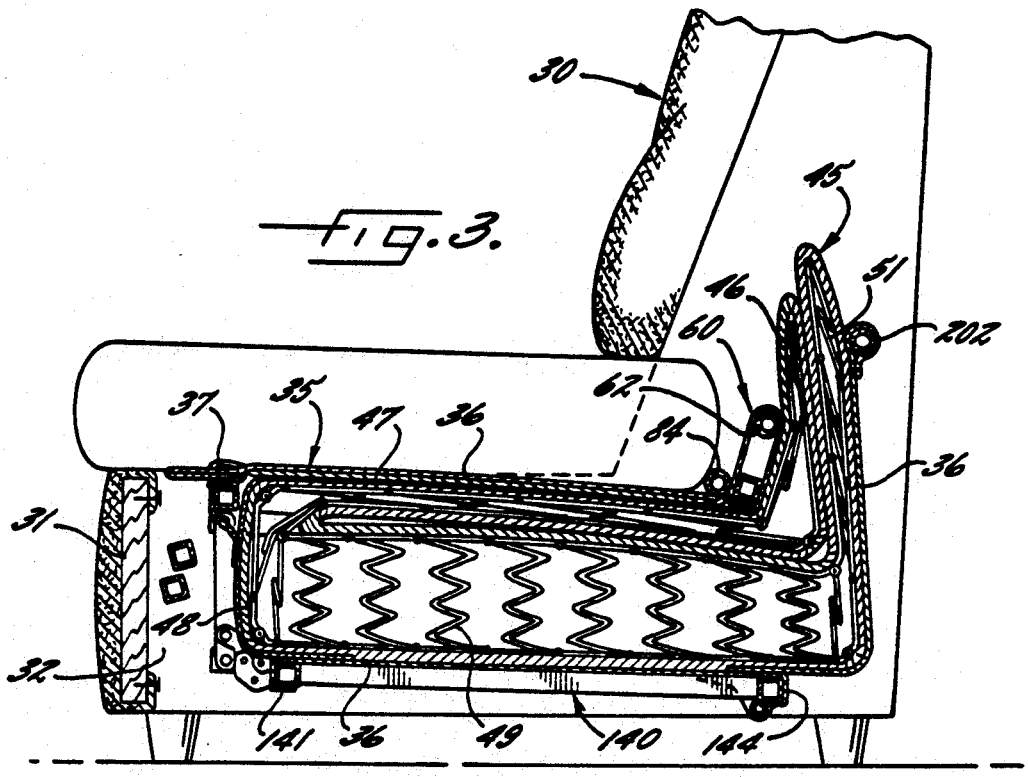
FIG. 3 is a cross-sectional view taken along line 3—3 of FIG. 1 of the fully folded position showing the collapsible and non-collapsible sections of the mattress.

The mattress 45 includes pivotally interconnected sections of uniform depth, at least one of which includes collapsible springs and at least one of which includes noncollapsible springs (FIG. 3). The collapsible springs collapse as the mattress is folded during the folding of the bed, thereby reducing the volume necessary for storage of the mattress. At present, collapsible springs are not easily manufactured, nor are they easily incorporated into the mattress; thus the use of more traditional noncollapsible springs is considerably less expensive. Combining sections which have either collapsible or noncollapsible springs permits the designer to strategically select those areas which require collapsible springs in order to reduce storage space while employing noncollapsible springs for those sections where space reduction is less critical. The smaller folded size affords the option of including a foldable bed in sofas which previously, in order to retain their low seat height or off-the floor styling, could not accommodate an attached foldable bed which employed a thick, firm mattress.

The present embodiment of the mattress 45 comprises a foot section 46, a seat section 47, a cavity section 48, a body section 49, and a head section 51 which are pivotally interconnected at their ends (FIG. 6), each of which is sized to rest upon and fold with a corresponding section of frame 56. In this embodiment the foot section 46, the seat section 47, the cavity section 48, and the head section 51 each include collapsible springs (FIG. 3), while the body section 49 includes a plurality of noncollapsible helical springs oriented with their longitudinal axes being vertical and their ends fixed to upper and lower wire frame grids which define the upper and lower surfaces of the mattress.

In the present embodiment, each collapsible section includes an upper wire surface and a lower wire surface defining the upper and lower mattress surface, each of which comprises a plurality of wires extending the length of the section. At regularly spaced intervals each wire includes a tight loop extended in the widthwise dimension and twisted at the loop end to accept a collapsible spring. Each collapsible spring comprises an M-shaped wire which includes a tight circular coil at each of its three vertices disposed in the same plane as that formed by the wire legs of the spring, although those skilled in this art will appreciate that any number of different configurations (some of which are described in U.S. Pat. No. 4,654,905 to Miller, the subject matter of which is incorporated herein by reference) might be used. The ends of the spring legs are attached to the twisted loops of the wires of the upper and lower wire surfaces by a coiling of each end of each spring about the wire to form a pivot about the axis of the loop. The springs are aligned with the ends of the legs of one spring in contact with two vertices of the adjacent spring across the width of the mattress 45. In the unfolded and extended position, the plane defining each spring is perpendicular to the upper and lower wire surfaces and to the plane of symmetry of the sofa; the springs are prevented from rotating about the wires of the lower and upper wire surfaces by the presence of the noncollapsible body section 49. During folding of the frame, each spring is free to pivot about the axis defined by its attachment wire loop. This pivoting of the springs causes the upper surface of the mattress to translate relative to the lower surface of the mattress, which translation eventually causes the upper and lower surfaces to come into contact with one another. In this collapsed position the plane defining each spring is substantially parallel with the upper and lower wire surface of the mattress sections.

The mattress 45 is supported on the frame by a deck 35 which comprises a polypropylene cloth 36 and plurality of one-way slats (not shown to preserve clarity of illustration) attached to the underside of the cloth 36 beneath the seat section 90 in the unfolded position. The cloth 36 is attached to the head end piece 202 and the foot end piece 62 by loops sewn into the cloth 36 and reinforced by steel wires, although those skilled in this art will appreciate that this attachment can be accomplished in a number of ways. The cloth 36 is also anchored to the mattress 45 itself beneath the seat and body sections to ensure that the mattress 45 remains oriented properly in the frame 56 and that the collapsible sections remain extended in the depth dimension in the unfolded position. Each one-way slat comprises a narrow steel strap and a plurality of thin steel blocks attached to the strap in abutted relation to each other; these slats are inserted into pockets on the underside of the cloth 36 with the steel blocks adjacent the cloth. In the unfolded position, pressure from above the slats causes the abutting side edges of the blocks to press laterally against one another. The blocks resist deflection under this lateral pressure, so the slats provide a substantially rigid support surface in the unfolded position. However, in the folded position, the orientation of the slat to the floor is reversed, so that the strap defines the upper surface of the slat. Pressure from above causes the strap to deflect such that the side walls of adjacent steel blocks separate from one another; as a result, the slat deforms in response to this overhead pressure and provides a comfortable seating platform.

Figure 2:
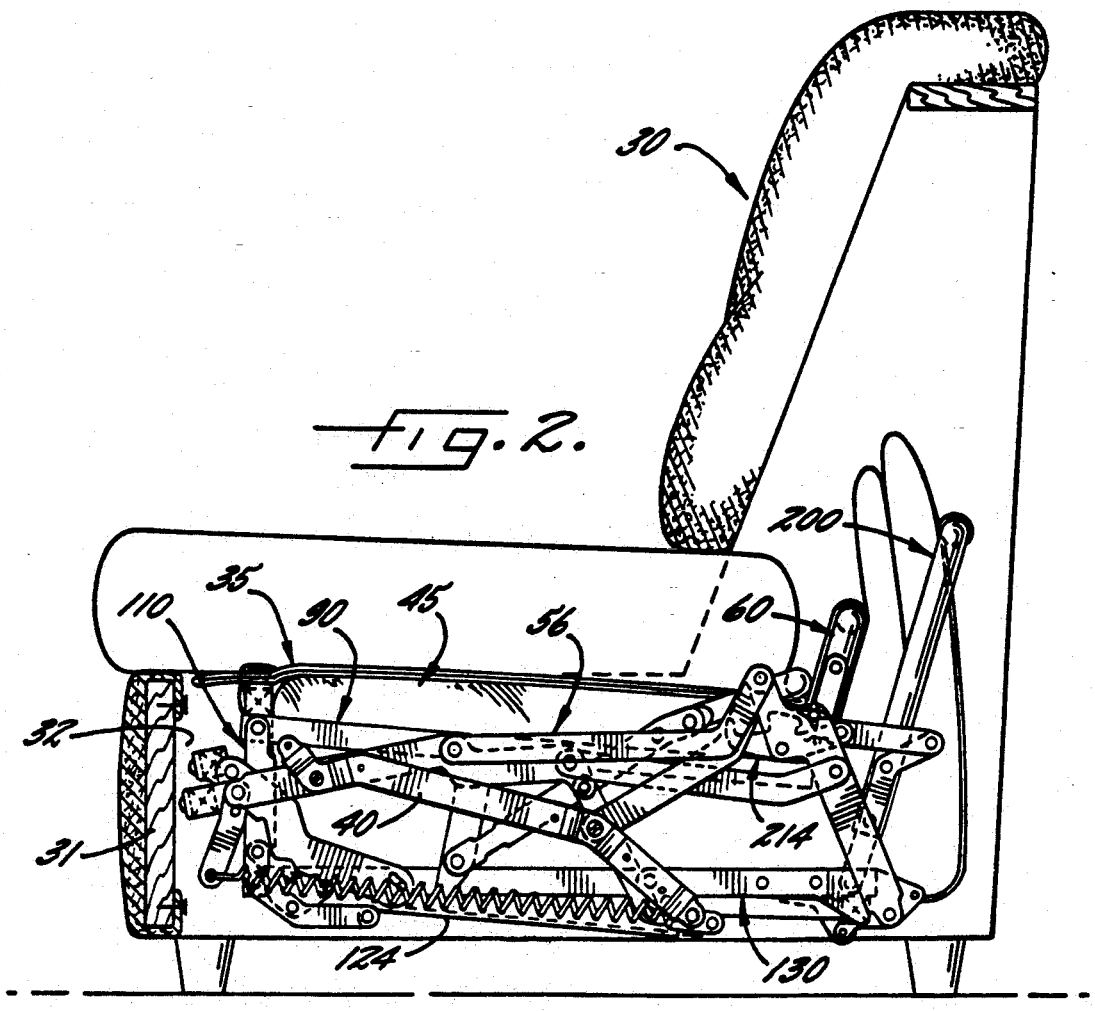
FIG. 2 is a side elevation view taken along line 2—2 of FIG. 1 showing the fully folded position of the bed within the sofa.

The unfolding of the bed 50 begins from the fully folded position shown in FIG. 2, wherein the head section 200 is substantially vertical, the body section 130 is generally horizontal, the seat section 90 overlies the body section 130, the cavity section 110 extends substantially vertically between the body and seat sections, the side rails 91 of the seat section are disposed along the sides of the mattress 45 and below the upper support surface of the mattress, and the foot section 60 is substantially vertical and adjacent the head section 200. By configuring the frame 56 and the interconnecting means 57 so that the frame 56 takes this configuration in the folded position, the cushions of the sofa 30 can rest on the upper surface of the inverted mattress 45 without the frame 56 interfering with the manner in which the cushion supports an occupant; as a result, the couch provides improved seating comfort over those of the prior art. Also noteworthy is the lowered body section 140. In this lowered position, the body section 49 of the mattress 45 rests beneath the side rail 131 of the body section 130, thereby lowering the actual storage height of the folded bed.

Figure 4:
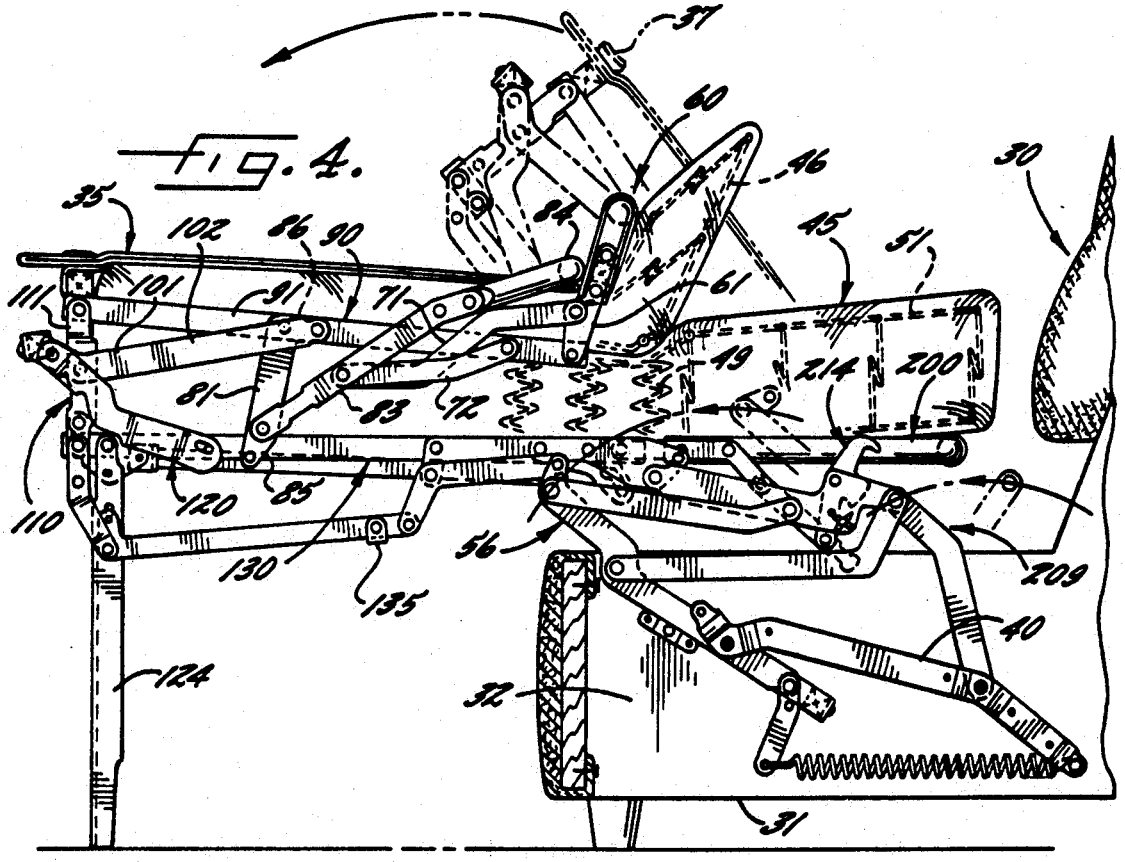
FIG. 4 is a side elevational view of the folded position wherein the bed has been unfolded from within the sofa, but the cavity, seat, and foot sections are still in the folded position.

As an operator applies a lifting force to a lifting strap 37 attached to the center of the support deck 35, the bed 50 moves to an intermediate folded position shown in FIG. 4. Under this force, the mounting assembly 40 causes the head section 200 to be disposed horizontally, body section leg 124 to assume a vertical position, and the still folded body section 130, cavity section 110, seat section 90, and foot section 60 to rise from the chamber 32 of the sofa 30 to a position external the chamber 32. The body section 130, cavity section 110, seat section 90, and foot section 60 remain in the same orientation relative to each other as in the fully folded position.

The bed is then moved from this intermediate folded position of FIG. 4 to the vertical position shown in FIG. 5 by an operator pulling on the leg extension 84 to release the squeeze locking mechanism. In the configuration shown in FIG. 4, there are three different sets of three interconnecting pivot points which are substantially linearly aligned and thus in an "on-center" locking orientation. The first set comprises the pivot of the longer arm 85 of the seat pivot link 81 and the leg member 83, the pivot of the foot section support link 72 and the leg member 83, and the pivot of the foot section support link 72 and the seat section side rail 91. The second set of pivots comprises the pivot of the seat pivot link 81 with the seat section side rail 91, the pivot of the shorter arm 86 of the seat pivot link 81 with the longer arm 102 of the cavity pivot link 101, and the pivot of the cavity pivot link 101 with the cavity section side rail 111. These two sets of pivots lock the seat section 90 into the folded position relative to the cavity section 110. The third set of pivots of the locking mechanism comprises the pivot of cavity pivot link 101 with the cavity section side rail 111, the pivot of the shorter leg 103 of the cavity pivot link 101 with the cavity drawing member 121, and the pivot of the cavity drawing member 121 with the body section side rail 131. This set of pivots locks the cavity section into the folded position relative to the body section. Each of these sets of aligned pivots becomes unaligned as the leg extension 84 separates from the frame 56. This configuration results in increased leverage at the end of the leg extension 84 for squeezing the mattress 45 into the locked orientation and for overcoming the locking resistance during unlocking than is present in current two-unit locking mechanisms; as a result, less force is required from the operator to lock and unlock the bed during folding and unfolding. In addition, because the leg extension 84 must travel along a longer arc than seen in current two-unit locking mechanisms before unlocking occurs, the unlocking operation is smoother than the unlocking of a two-unit locking mechanism.

The motion of the leg extension 84 also causes the foot section 60 to rotate about the seat section 90 into alignment with the seat section. The leg member unit 82 draws the longer arm 85 of seat pivot link 81 to the underside of the seat section 90 and into alignment with the leg member unit 82, thus completely unfolding the full leg assembly 80. This action causes the shorter arm 86 of the seat pivot link 81 to drive the longer leg 102 of cavity pivot link 101, which in turn rotates the seat section 90 about the cavity section 110. Concurrently, the shorter arm 103 of the cavity pivot link 101 is driven by the longer arm 102 to cause the cavity drawing link 121 to pivot the cavity section 110 about the body section 130. FIG. 5 also illustrates that the foot section 46, the seat section 47, and the cavity section 48 of the mattress 45 are still in a partially collapsed condition.

Figure 13:
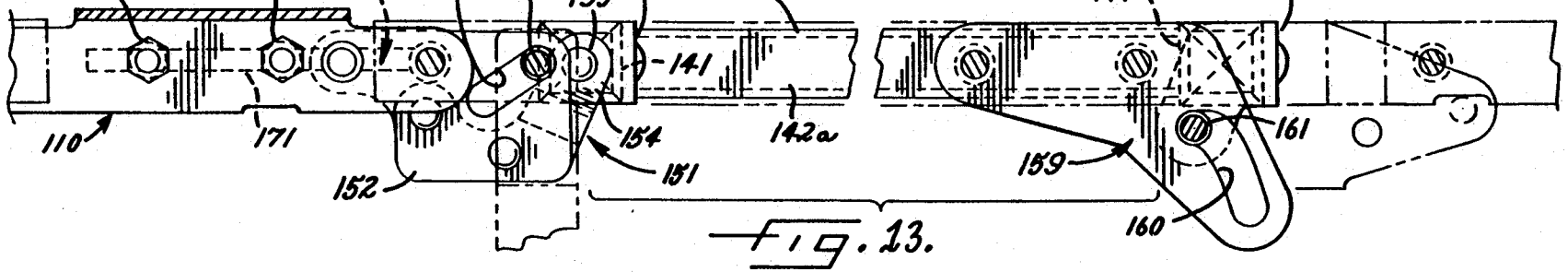
FIG. 13 is a cross-section view taken along line 13—13 of FIG. 12 showing the body section lowering unit.
Figure 14:
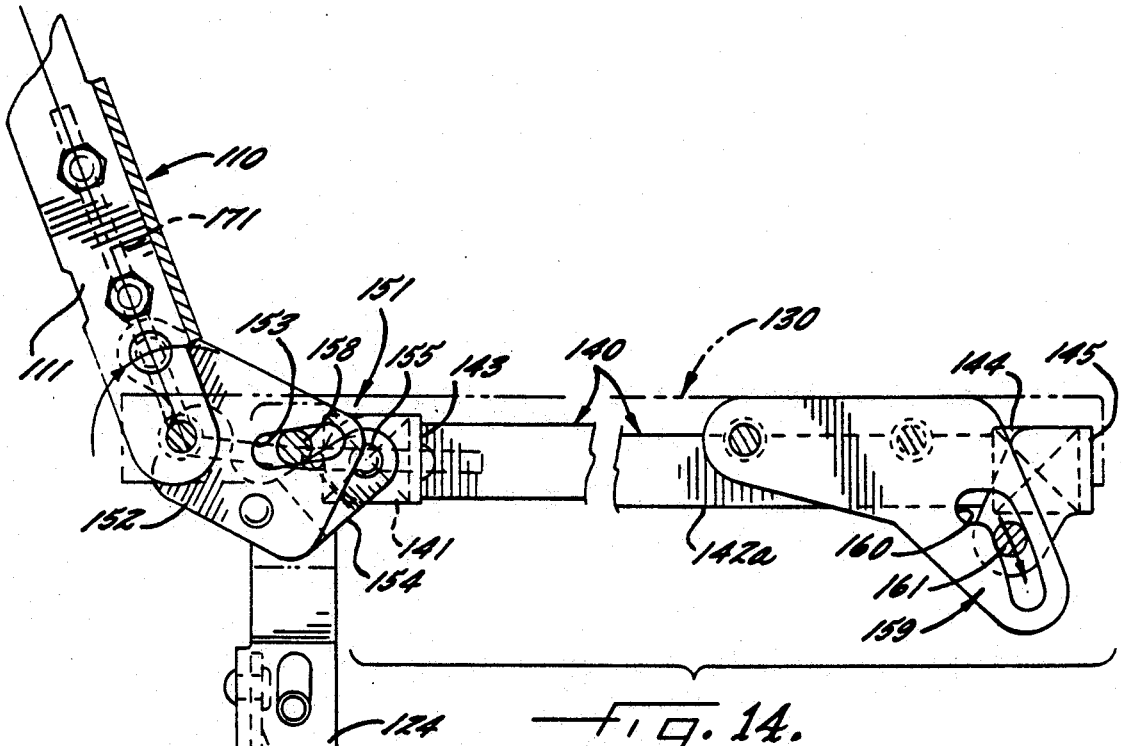
FIG. 14 is a side elevation enlargement of the body section lowering unit showing the unit during pivotal movement of the cavity section about the body section.
Figure 15:
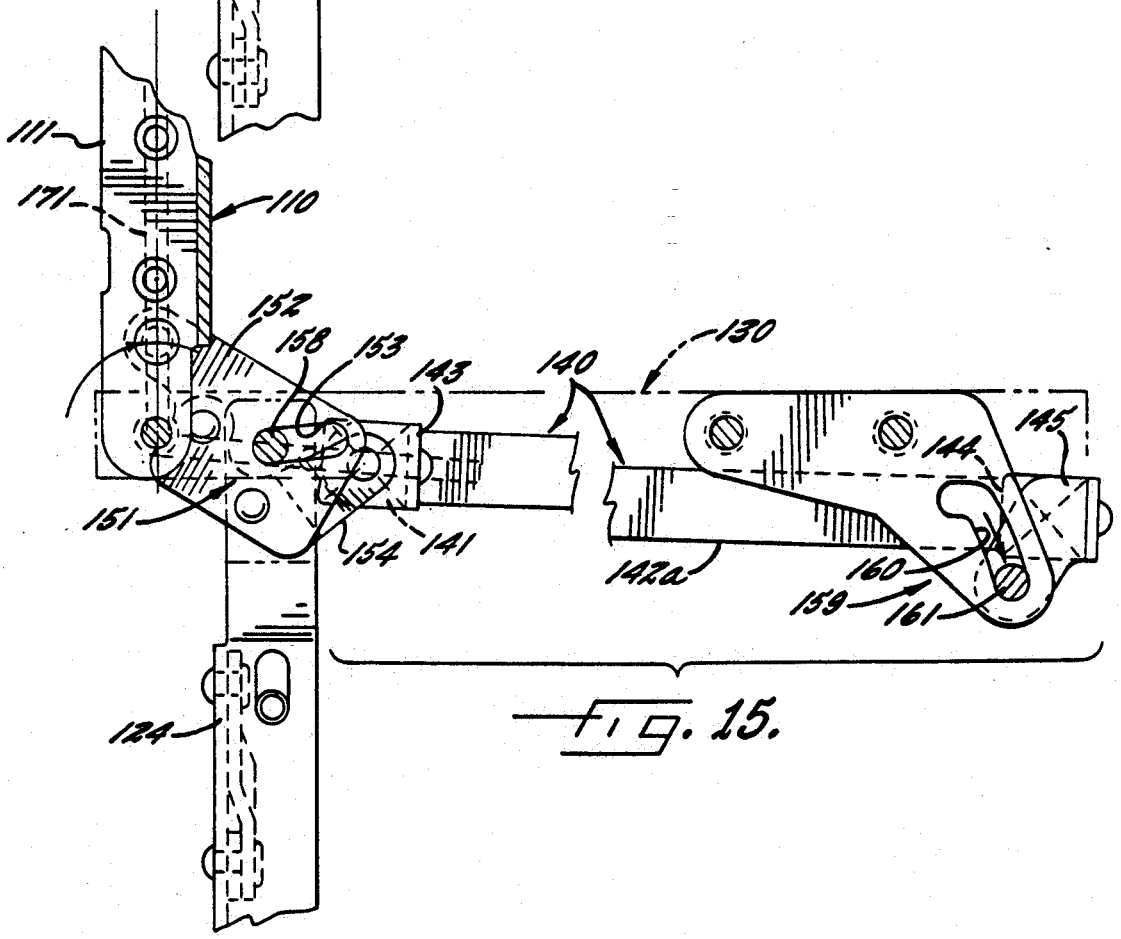
FIG. 15 is a side elevation enlargement of the body section lowering unit showing the unit in the fully lowered position.

Also concurrent is the raising of the body section support assembly 140. As seen in FIGS. 13–15, the rotation of the cavity section 110 causes the slotted member 152 of the front lowering unit 151 to move toward the foot end of the bed. The rotation causes the headward end of the slotted member 152 to rise and move footward as the slot 153 moves along the pin 158. As the headward end of the slotted member 152 rises, the support member 155 also rises accordingly, carrying with it the body support section 140 in order to align the lower surface of the body section 49 of the mattress 45 with the other sections of the mattress.

As the bed moves from the vertical position of FIG. 5 to the unfolded position of FIG. 6, a force directed away from the head section 200 on the leg end piece 62 ultimately causes the seat section 90 to align with the cavity section 110 and cavity section 110 to align with body section 130. This action causes the cavity drawing link 121 to be driven by the shorter arm 103 of the cavity pivot link 101 toward the head section 200, with the result being that the pin 132 is located in the slot 122 in the end thereof nearest the cavity section 110. The unfolding halts as the cavity drawing link 121 comes to rest upon the pin 126. At this point the mattress 45 is also fully unfolded and all collapsible sections are fully extended in the depth dimension.

Figure 17:
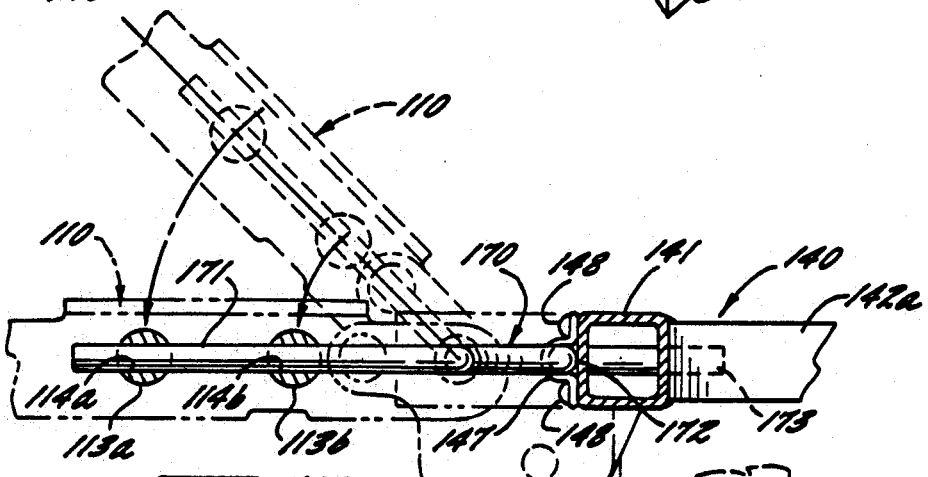
FIG. 17 is a cross-sectional view taken along line 17—17 of FIG. 16 showing the torsion bar in the unfolded position as compared to the first intermediate position.
Figure 18:
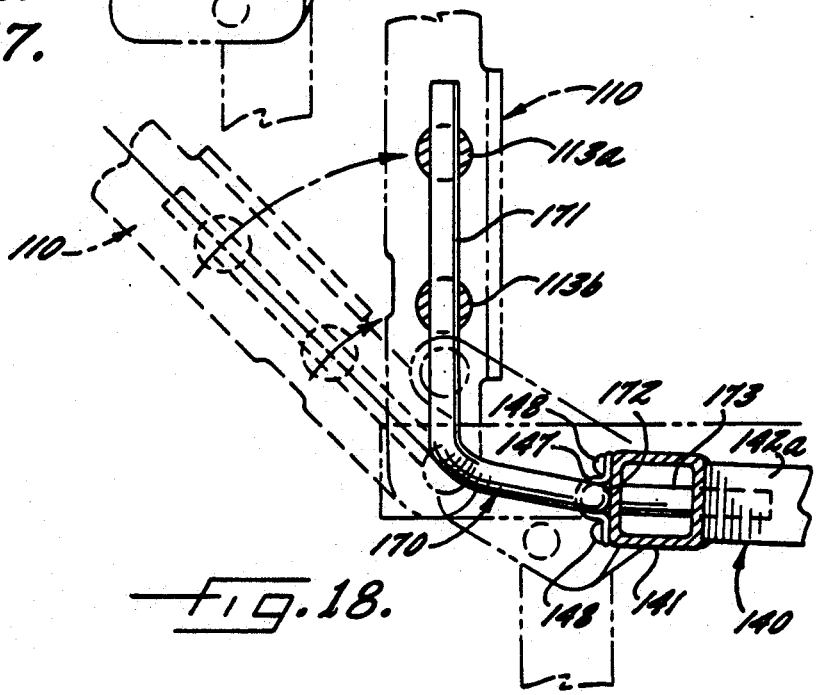
FIG. 18 is a cross-sectional view of the torsion bar in the second intermediate position as compared to the first intermediate position.
Figure 19:
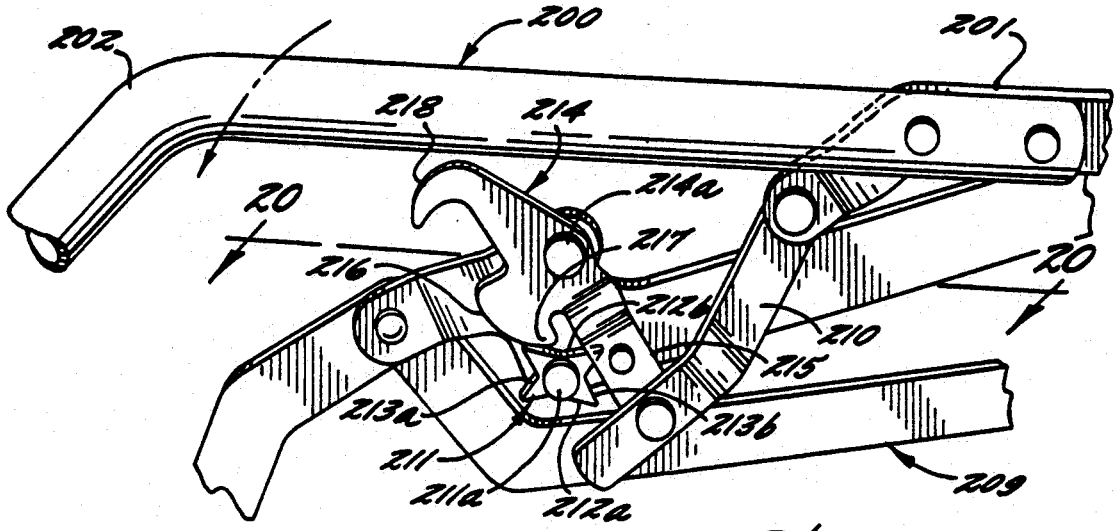
FIG. 19 is a perspective view of the headrest mechanism.
Figure 20:
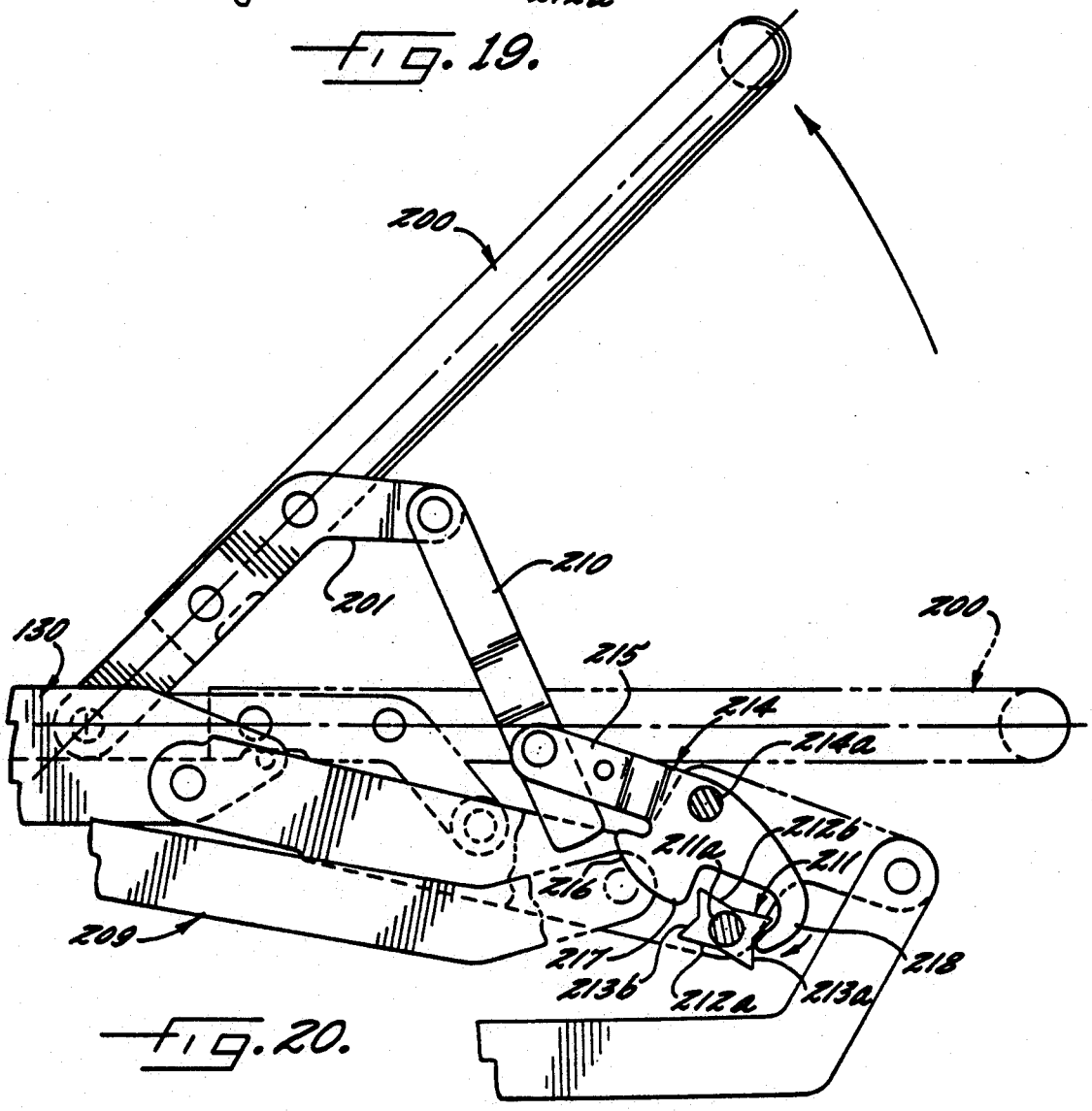
FIG. 20 is a side elevational view taken along line 20—20 of FIG. 19 showing the head section at a position just beyond the inclined position and the locking member in its second rotative orientation.
Figure 21:
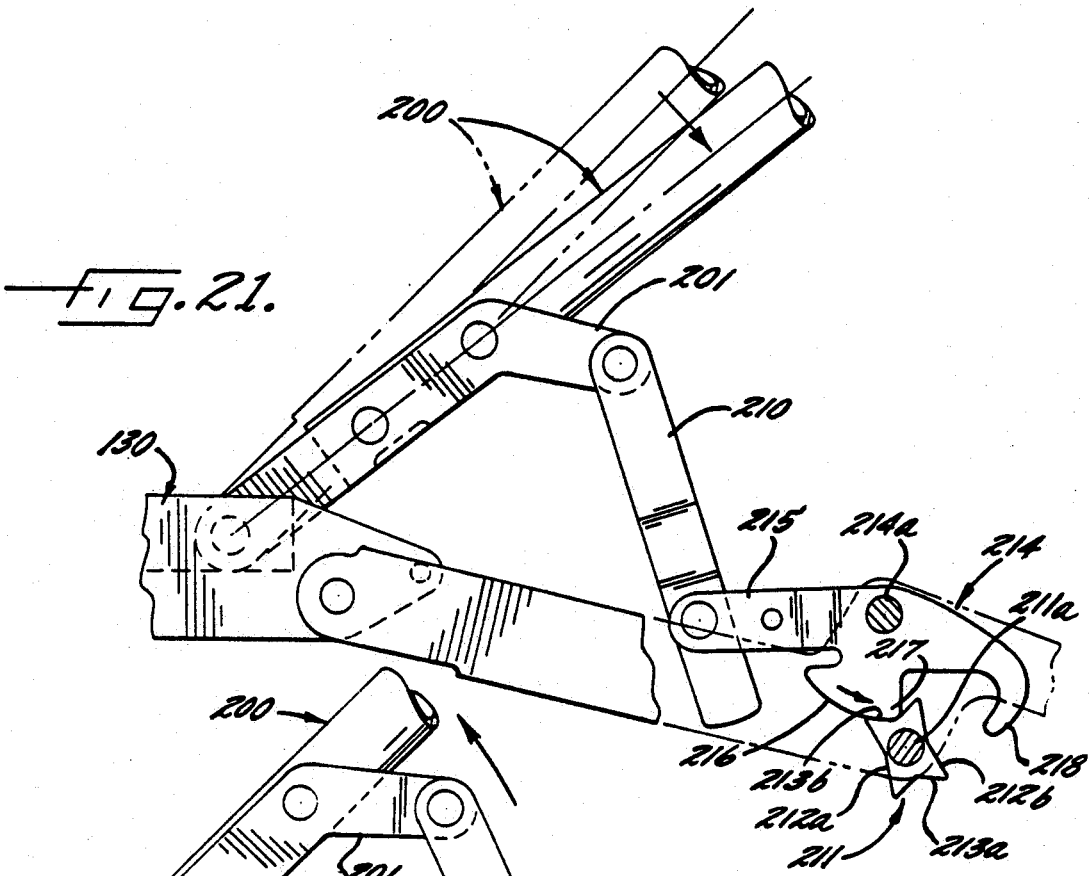
FIG. 21 is a side elevational view of the headrest locked in the inclined position and the locking member in its third rotative orientation.

In addition, as the bed 50 unfolds from the generally vertical position of FIG. 5, the torsion segment 172 of torsion bar 170 is in torsion and biases the frame 50 toward an intermediate position (shown in dotted lines on FIG. 18) between the generally vertical position of FIG. 5 and the unfolded position of FIG. 6. The torsion is relieved as the bed passes to this intermediate position. As the bed advances past the intermediate position, torsion returns to the torsion section 172 of the torsion bar 170 and resists the further unfolding of the bed (FIG. 17). The torsion bar is included in this embodiment to provide additional lift to one who is attempting to move the bed from the unfolded position to the folded position, and also to provide resistance to the weight of the be as it unfolds from the intermediate position, which makes the unfolding bed easier to control. The assistance the torsion bar lends is particularly important in beds such as this which employ a thick, firm, heavy mattress. Those skilled in this art will appreciate that any means that will bias the cavity and seat sections toward the intermediate position from the unfolded and generally vertical positions would be suitable for this purpose.

The folding of the bed 50 from the unfolded position reverses the sequence of linkage movements just described with one notable exception. Because the pin 132 is located toward the foot end of the slot 122, the cavity drawing member 121 is an incompletely constrained link. As the foot end piece 62 is lifted to begin the folding sequence, there is no constrained four bar linkage to cause the cavity section 110 to pivot about the body section 130. As a result, the movement of the cavity drawing member 121 is then controlled by the engagement of the cammed edge 123 on the pin 126. The camming angle of the cammed edge 123 is chosen to ensure that the cavity section 110 pivots about the body section 130 simultaneously with the seat section 90 pivoting about the cavity section 110. This action draws the cavity drawing link 121 toward the cavity section 90, but not until the headmost end of the slot 122 reaches the pin 132 is the motion of the cavity section 110 controlled by the cavity drawing member 121 pivoting about pin 132. As a result, the sequence of initial pivotal movement of the seat section 90 and the cavity section 110 is controlled, and any tendency for reverse pivotal movement of the seat section 90 about the cavity section 110 is prevented. The absence of this reverse pivotal movement prevents the linkage mounting the bed to the sofa from beginning to fold prematurely, i.e., before the seat, cavity, and body sections have folded upon one another. In addition, the operator will not feel the undesirable abrupt lurching or jerking motion that accompanies reverse pivotal movement of the seat section.

Figure 22:
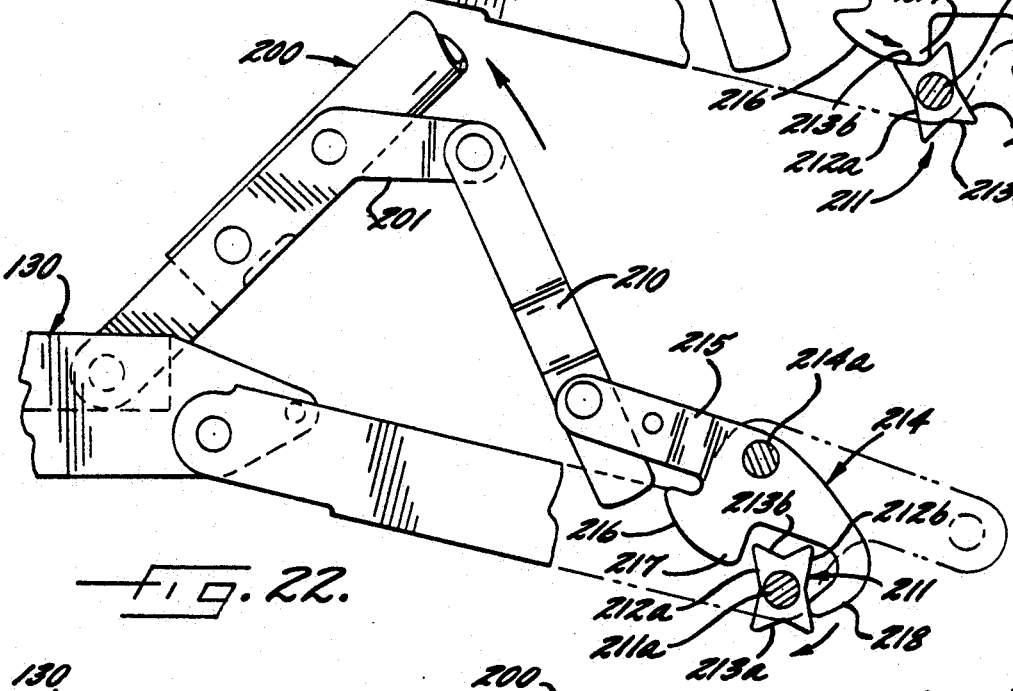
FIG. 22 is a side elevational view of the headrest as the hooking arm rotates the locking member to its fourth rotative orientation.
Figure 23:
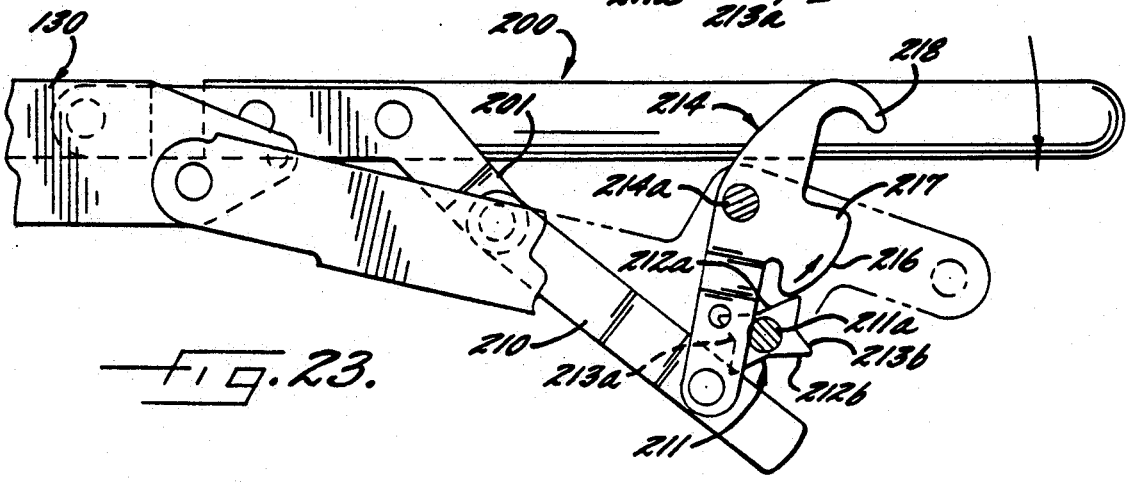
FIG. 23 is a side elevational view of the headrest showing the fifth rotative orientation of the locking member.

In the operation of the headrest mechanism 209, the head section 200 is pivoted about the body section 130 from the horizontal unfolded position to a position just beyond the inclined position. As this action occurs, the latching link 214 rotates about its pivotal attachment to the mounting unit 40 so that the camming edge 216 of the latching link 214 glides along the concave edge **212*b* of the lock member 211 and retains the locking member 211 in a first rotative orientation. This first orientation permits the hooking arm 218 of the latching link 214 to engage a notched edge 213*a*, which engagement causes further rotation of the lock member 211 to a second rotative orientation shown in FIG. 20. In the second orientation, the opposite notched edge 213*b* engages the retaining edge 217 of the latching link 214 as the head section 200 is lowered slightly into the inclined position, causing further rotation of the locking member 211 into a third rotative orientation (FIG. 21), which locks the head section 200 into place. The headrest is disengaged by raising the head section 200 from the inclined position to a position just beyond the inclined position. This pivotal movement causes the hooking arm 218 to engage the concave edge 212*b* and thereby rotate the locking member 211 to a fourth rotative orientation (FIG. 22). As the head section 200 is returned to the horizontal position, the camming edge 216 engages the concave edge 212*a* and causes the locking member 211 to rotate to a fifth orientation diametrically opposite the first orientation (FIG. 23**). This configuration eliminates entirely the slotted member adapted to receive a sliding lock member present in most current headrest mechanisms.

Figures 24, 25:
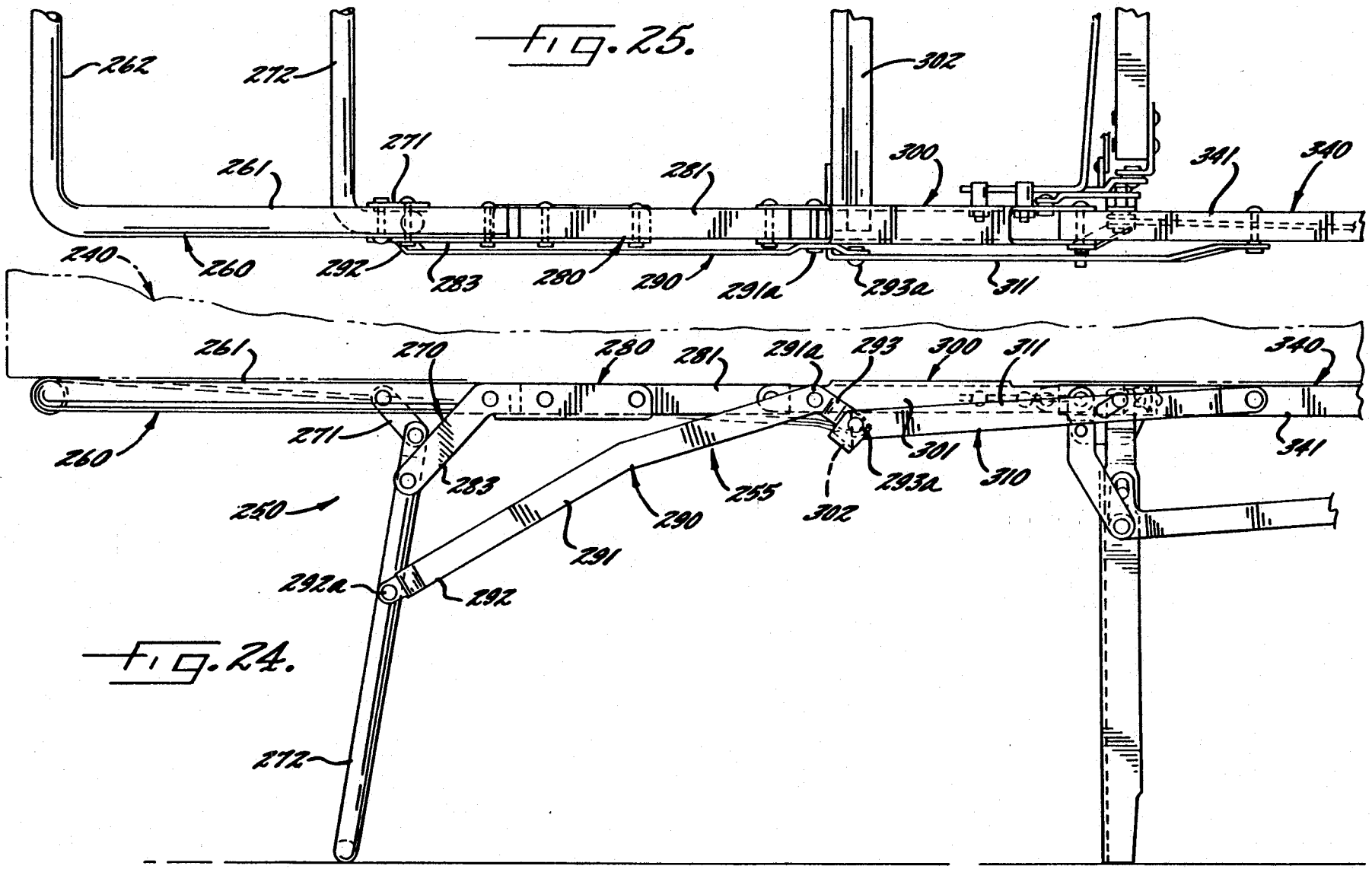
FIG. 24 is a partial side elevation view of a foldable bed frame suitable for use with a mattress having only noncollapsible springs shown in the unfolded position.
FIG. 25 is a partial plan view of the bed frame of FIG. 24 in the unfolded position.
Figure 26:
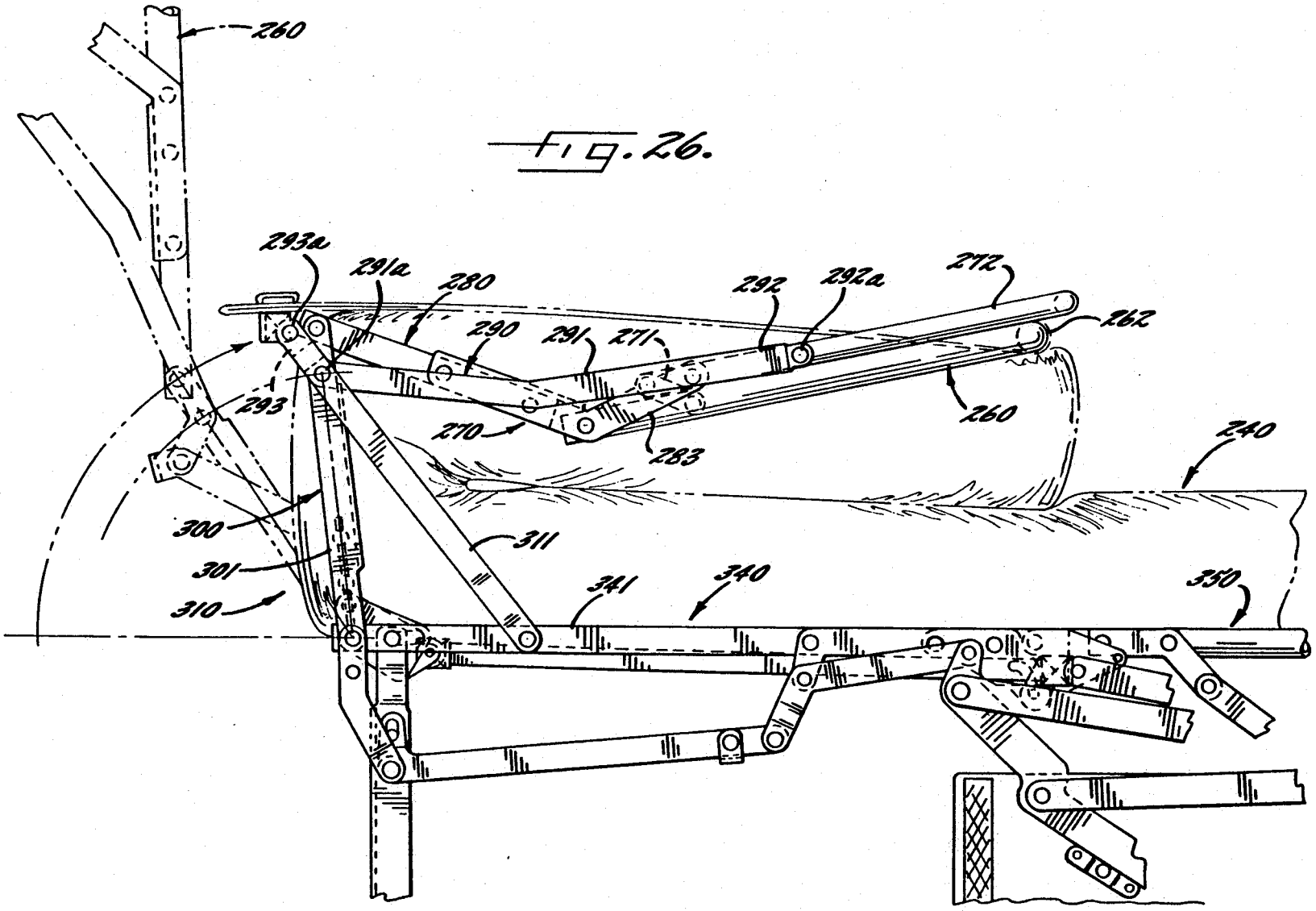
FIG. 26 is a partial side elevational view of the frame of FIG. 24 in the folded position.

Another embodiment of the invention, that of a foldable bed suitable for use with a conventional mattress 240, is illustrated in FIGS. 24–26. In this embodiment, the head section, mounting unit, body section, and body section leg are identical to those of the embodiment described in FIGS. 1-23; the foot section, seat section, cavity section, and interconnecting means differ from those of the first embodiment. The bed comprises a frame 250 and an interconnection unit 255 for pivotal movement of the bed frame 250. Frame 250 comprises a foot section 260, a seat section 280 pivotally interconnected to the foot section 260, a cavity section 300 pivotally interconnected to the seat section 280 on the end thereof opposite the foot section 260 and pivotally interconnected to a body section 340 on the end thereof opposite a head section 350, the body section 340 pivotally interconnected to the head section 350, and the head section 350. The interconnection unit 255 comprises a foot section linkage unit 270, a seat section linkage unit 290, and a cavity section linkage unit 310.

The foot section 260 comprises a side rail 261 and an end portion 262 which extends the width of the frame 250 to meet the corresponding side rail on the opposite side of the frame. Pivotal movement of the foot section 260 about the seat section 280 is controlled by the foot section linkage unit 270, which comprises a foot section control link 271, a leg member 272, and a leg extension arm 283. The foot section control link 271 is pivotally interconnected to the foot section 260 at the end thereof nearest the seat section 280. The leg member 272 is pivotally interconnected to the foot section control link 271 on the end thereof opposite the foot section 260. The seat extension arm 283 is fixed to the seat section 280 on the end thereof nearest the foot section 260 and is pivotally interconnected to the leg member 272 intermediate the pivot of the foot section control link 271 and the leg member 272 and the pivot of the leg member 272 and a longer arm 292 of a cavity pivot link 291.

The seat section 280 comprises a side rail 281 pivotally interconnected to the foot section side rail 261 on the end thereof opposite the end portion 262. The seat extension arm 283 is fixed to the seat section side rail 261 on the end thereof nearest the foot section 260 and extends downward at approximately a 45 degree angle to pivotally interconnect with the leg member 272.

The pivotal movement of the seat section 280 about the cavity section 300 is controlled by the seat section linkage unit 290, which comprises the leg member 272 and a cavity pivot member 291. The cavity pivot member 291 is substantially L-shaped and is pivotally interconnected to a cavity section side rail 301 at its vertex 291*a*. The longer arm 292 of the cavity pivot member 291 is pivotally interconnected at 292*a* to the leg member 272 between the end thereof that rests on the floor in the unfolded position and the pivot of the leg member 272 and the seat extension arm 283.

The cavity section 300 comprises a side rail 301 and a cavity section cross bar 302. The side rail 301 is pivotally interconnected to the seat section side rail 281 at the end thereof opposite the foot section 260 and is also pivotally interconnected at the other end to the body section 340. The cavity section cross bar 302 is fixed to the interior surface of the side rail 301 and extends to meet the corresponding side rail on the other side of the frame.

The pivotal movement of the cavity section 300 about the body section 340 is controlled by the cavity section linkage unit 310, which comprises the shorter arm 293 of the cavity pivot member 291 and the cavity drawing link 311. The cavity drawing link is pivotally interconnected on one end to the shorter arm 293 and is pivotally interconnected at the other end to the body section 340.

The bed frame 250 is moved from the folded position shown in FIG. 26 to the unfolded position shown in FIG. 24 by applying a lifting force to the leg member 272. The bed as shown in FIG. 26 is locked into position by the linear orientation of two sets of pivots: the pivots of the cavity drawing link 311 on the body section side rail 301, the cavity pivot member 291 on the cavity section side rail 301, and the cavity drawing link 311 on the shorter arm 293 of the cavity pivot member 291; and the pivots of the cavity drawing link 311 on the shorter arm 293 of the cavity pivot member 291, the cavity pivot member 291 on the cavity section side rail 301, and the cavity drawing link 311 and seat section side rail 341. As the leg member 272 pivots about the foot section control link 271, it draws the longer arm 292 of the cavity pivot member 291 upward, which in turn causes the shorter arm 293 of cavity pivot member 291 to pivot about the cavity drawing link 311 and move that pivot out of line with those mentioned above. The movement of these latter two pivots also moves them out of alignment with the pivot of the cavity drawing link 311 and the seat section side rail 341. The forced misalignment of these two sets of three pivots unlocks the mechanism. As the lifting force on the leg link 272 is maintained, the shorter leg 292 of the cavity pivot member 291 continues to drive its pivot point with the cavity drawing member 311 away from the cavity section 300, which causes the cavity section 300 to pivot about the body section 340 toward the unfolded position. Lifting of the leg member 272 also lifts the leg extension arm 283, which causes the seat section 280 to pivot about the cavity section 300. Simultaneously, the lifting of the leg member 272 causes it to pivot about the leg extension arm 283 and thereby force its pivot with the foot section control link 271 to move away from the foot section 260, which action causes the foot section 260 to pivot about the seat section 280 until these sections are aligned and the leg assembly 270 is fully extended. This occurs as the seat section 280 and the foot section 260 are approximately vertical.

From this vertical position a lateral force on the foot end member 262 directed away from the head section then causes the seat section 280 to pivot about the cavity section 300 and to horizontally align with it. At the same time, the shorter arm 293 of the cavity pivot member 291 pivots about the cavity drawing link 311 and thus urges the cavity section 300 to align horizontally with the body section 330.

Folding the bed from the unfolded position of FIG. 24 to the folded position of FIG. 26 requires that a lifting force be applied to the foot end member 262. In response, the linkages reverse the motion described above to return the bed to the folded position shown in FIG. 26. The bed is locked into the folded position when the linkages maneuver the pivots of the cavity drawing link 311 on the body section side rail 301, the cavity pivot member 291 on the cavity section side rail 301, and the cavity drawing link 311 on the shorter arm 293 of the cavity pivot member 291 into linear alignment with one another, and the pivots of the cavity drawing link 311 on the shorter arm 293 of the cavity pivot member 291, the cavity pivot member 291 on the cavity section side rail 301, and the cavity drawing link 311 and seat section side rail 341 into linear alignment with one another. The seat section 280 and the foot section 260 assume a shallow V-shaped outline when viewed in side elevation, as in FIG. 26, and are disposed below the upper support surface formed by the mattress along substantially the entire lengths of the side rails 261 and 281 of said seat and foot sections. From this position the bed can be folded into the storage chamber of a sofa. It can be seen in FIG. 26 that the majority of the lengths of the foot section side rail 261 and the seat section side rail 281 lie below a plane extending from the uppermost end of the cavity section 300 and the uppermost end of the foot section 260. As such, the upper surface of the folded mattress is disposed above the side rails. As a result, the frame and mattress are positioned to avoid the impairment of the seating comfort of an occupant seated on a cushion laying upon the upper surface of the mattress.

The drawings and specification disclose typical preferred embodiments of the invention and, although specific terms are employed, they are used in a generic and descriptive sense only and not for the purposes of limitation, the scope of the invention being set forth in the following claims.

That which is claimed is:

1. A foldable bed movable between an unfolded extended and generally horizontal position, and a folded position, which comprises:

(a) a frame comprising a body section, an intermediate cavity section, a seat section, and a foot section, with each section comprising a pair of laterally spaced apart side rails;

(b) means pivotally interconnecting each of said frame sections to at least one adjacent section for pivotal movement between the unfolded position and the folded position; and (c) a mattress carried by said frame and movable therewith between the unfolded and folded positions, and wherein in the folded position said mattress is folded upon itself to define an upper support surface;

wherein said interconnecting means are constructed and arranged such that in the unfolded position said body section, said cavity section, said seat section, and said foot section are serially and horizontally aligned, and said side rails of said sections are positioned along respective opposite sides of and generally below said mattress, and in the folded position, said body section is generally horizontal, said seat section overlies said body section, said cavity section extends substantially vertically between said body and seat sections, and said side rails of said seat section are disposed along the sides of said mattress and below said upper support surface.

2. The foldable bed as defined in claim 1 wherein said interconnecting means further comprises means for pivoting said foot section between a horizontal position when said bed is in the unfolded position, and a generally upright position when said bed is in the folded position.

3. A foldable bed as defined in claim 2 which further comprises a leg member for supporting said frame beneath said seat section in the unfolded position pivotally interconnected with said foot section and with said seat section, and wherein said interconnecting means comprises:

(a) foot section linkage means for pivotaing said foot section pivotally interconnected with said leg member;

(b) seat section linkage means for pivoting said seat section operatively interconnected with said leg member; and (c) cavity section linkage means for pivoting said cavity section operatively interconnected with said seat section linkage.

4. A foldable bed as defined in claim 3 wherein said foot section linkage means comprises:

(i) a foot section support link pivotally connected at one end to said seat section and pivotally connected at its other end to said leg member;

(ii) a foot section control link pivotally connected at one end to said foot section and pivotally connected at its other end to said foot section support link; and (iii) a seat pivot member having a longer leg and a shorter leg pivotally interconnected about its vertex to said seat section and pivotally connected at its longer leg to said leg assembly;

and wherein said seat section linkage means comprises:

(iv) and shorter leg of said seat pivot member; and (v) a cavity pivot member having a longer leg and a shorter leg pivotally interconnected at about its vertex to said cavity section and pivotally connected at its longer leg to said shorter leg of said seat pivot member;

and wherein said cavity section linkage means comprises:

(vi) said shorter leg of said cavity pivot member; and (vii) a cavity drawing link pivotally interconnected to said shorter leg of said cavity pivot member and slidably and pivotally connected to said body section.

5. The foldable bed as defined in claim 1 wherein in the folded position said side rails of said seat section and said foot section assume a shallow V-shaped outline when viewed in side elevation and are disposed below said upper support surface along substantially the entire lengths of said side rails.

6. The foldable bed defined in claim 5 wherein said bed further comprises a foot section leg assembly pivotally connected to said foot section and said seat section for supporting said foot section in the unfolded position, said foot section supporting leg assembly comprising a foot section control link and a leg member pivotally connected to said foot section control link.

7. The foldable bed defined in claim 6 wherein said interconnecting means comprises:

(a) foot section interconnecting means for pivoting said foot section pivotally interconnected to said leg member;

(b) seat section interconnecting means for pivoting said seat section operatively interconnected to said foot section interconnecting means; and (c) cavity section interconnecting means for pivoting said cavity section operatively interconnected to said seat section interconnecting means.

8. The foldable bed defined in claim 7 wherein said foot section interconnecting means for pivoting said foot section comprises:

(i) said foot section control link pivotally interconnected to said foot section;

(ii) an extension arm fixed to said seat section on the end thereof opposite said cavity section and pivotally interconnected to said leg member; and (iii) said leg member pivotally interconnected to said foot section control link;

and wherein said seat section interconnecting means comprises:

(iv) said leg member; and (v) a cavity pivot link pivotally connected at its vertex to said cavity section having a longer angled arm and a shorter arm, said longer angled arm being pivotally connected to said leg member of said foot support assembly;

and wherein said cavity interconnecting means comprises:

(vi) said shorter arm of said cavity pivot link; and (vii) a cavity drawing link pivotally interconnected to said body section on one end and to said shorter arm of said cavity pivot link on the other end.

9. The foldable bed as defined in claim 1 wherein said frame further comprises a head section including a pair of laterally spaced side rails pivotally interconnected to said body section on the end thereof opposite said cavity section, and wherein said interconnecting means further comprises means for pivoting said head section between a horizontal orientation when said bed is in the unfolded position and a substantially vertical position when said bed is in the folded position.

10. A foldable bed as defined in claim 9 wherein said head section further comprises linkage means mounting said head section for movement between a horizontal position and an inclined position when said bed is in the unfolded position, and for releasably locking said head section in the inclined position, comprising:

(a) a mounting linkage connected to said frame;

(b) a locking member pivotally connected through its center to said mounting linkage having a pair of concave arcuate edges on opposing sides of said pivot and a pair of notched edges on the opposing sides of said pivot perpendicular to those of said concave arcuate edges;

(c) a latching link pivotally connected to said mounting linkage which includes a C-shaped portion, said C-shaped portion having a hooking arm on its end opposite said pivotal connection for rotating said locking member and retaining edge facing said hooking arm, and a convex arcuate camming edge disposed in the same direction as said hooking arm; and (d) means for rotating said latching link.

11. The foldable bed as defined in claim 1 wherein said mattress comprises a body section overlying said body section of said frame, a cavity section overlying said cavity section of said frame, a seat section overlying said seat section of said frame, and a foot section overlying said foot section of said frame, wherein said sections of said mattress are of uniform depth in the unfolded position, and wherein said cavity section, said seat section, and said foot section of said mattress each are collapsible in the depth dimension when said bed is in the folded position.

12. The foldable bed as defined in claim 11 wherein said frame further comprises a head section including a pair of laterally spaced side rails pivotally interconnected to said body section on the end thereof opposite said cavity section, said interconnecting means further comprises means for pivoting said head section between a horizontal orientation when said bed is in the unfolded position and a substantially vertical position when said bed is in the folded position, and said mattress further comprises a collapsible head section pivotally interconnected to said body section of said mattress which overlies said head section of said frame and pivots therewith.

13. The foldable bed as defined in claim 12 wherein said body section of said mattress includes:

(a) a wire frame defining the periphery of said body section and having an upper and a lower surface comprising a plurality of wires extending the width of said mattress; and (b) noncollapsible helical springs fixed at either end to said upper surface and said lower surface of said frame; and wherein said head, cavity, seat, and foot sections each include (c) a wire frame defining the periphery of said sections and having an upper and a lower surface comprising a plurality of wires extending the length of said mattress, each of said wires having means for pivotal interconnection with collapsible springs;

(d) a plurality of collapsible springs, each comprising a M-shaped wire, each of the vertices of said wire having a tight circular coil, the circle of said coils being disposed in the same plane as said legs, and each of the legs of said springs having attachment means adapted to pivot about said pivotal interconnection means of said mattress wires;

so that as the frame moves to the folded position from the unfolded position, said upper surfaces of said cavity, seat, and foot sections translate along the length dimension of the bed relative to their corresponding lower surfaces, and thereby cause these sections to collapse in the depth dimension.

14. The foldable bed as defined in claim 1 wherein said frame further comprises a body section support assembly attached to said body section beneath said mattress, and said interconnection means further comprises means mounting said body section support assembly for movement between a raised position in horizontal alignment with said other sections when said bed is in the unfolded position and a lowered position below said raised position when said bed is in the folded position, and means for causing said body section support assembly to move between said raised and lowered positions when the bed is moved between the unfolded and folded positions.

15. The foldable bed defined in claim 14 wherein said means mounting said body section support assembly includes a pair of lowering members, each of which is pivotally connected and responsive to movement of one of said pair of side rails of said cavity section and further attached to said body section support assembly, wherein as said bed moves from the folded position to the unfolded position, the rotation of said lowering members causes said body section support assembly to rise and translate toward the end of said body section connected to said cavity section.

16. The foldable bed as defined in claim 1 wherein said interconnecting means further comprises means for causing said cavity section, said seat section, and said foot section of said frame to assume a first intermediate position between the unfolded position and a second generally vertical intermediate position, and for biasing said cavity section, said seat section, and said foot section of said frame toward said first intermediate position when said bed is in either the unfolded position or the second intermediate position.

17. A foldable bed as defined in claim 16 wherein said means for causing said cavity section and said seat section to assume a first intermediate position comprises a torsion bar having a cavity segment, a torsion segment, and a body segment, said cavity segment being perpendicularly attached at one end to said torsion segment and fixed at its other end to said cavity section, and said body segment being attached to said torsion segment on the end thereof opposite said cavity segment perpendicularly to said torsion segment and attached at its other end to said body section, wherein said cavity segment extends from said torsion segment within the plane defined by said side rails of said seat section in the second intermediate position and the plane defined by said side rails of said seat section in the unfolded position.

18. The foldable bed as defined in claim 1 wherein said interconnecting means further comprises cavity interconnection means for causing said seat section to pivot about said cavity section toward the folded position substantially simultaneously with the pivoting of said cavity section about said body section toward the folded position, thereby preventing reverse pivotal movement of said seat section about said cavity section.

19. The foldable bed as defined in claim 1 which further comprises means for locking said bed into the folded position comprising:

(i) a leg member pivotally interconnected with said seat section movable between a folded condition and an unfolded condition;

(ii) a first locking means for restraining pivotal movement of said seat section about said cavity section when said bed is in the folded position, said first locking means being responsive to the pivotal movement of said leg member, and being pivotally interconnected to said seat section;

(iii) a second locking means for restraining pivotal movement of said seat section about said cavity section when said bed is in the folded position, said second locking means being responsive to the movement of said first locking means and being pivotally interconnected to said seat section and said cavity section; and (iv) a third locking means for restraining pivotal movement of said cavity section about said body section when said bed is in the folded position, said third locking means being responsive to the movement of said second locking means and being pivotally interconnected to said cavity section and said body section;

wherein when the bed is in the folded position, movement of said leg member into its folded condition causes said first locking means and said second locking means to restrain the pivotal movement of said seat section about said cavity section and said third locking means to restrain the pivotal movement of said cavity section about said body section.

20. A foldable bed as defined in claim 1 further comprising mounting means for mounting said bed within a sofa, and linkage means for folding said frame to lie within said sofa in the folded position.

21. A foldable bed movable between an unfolded extended and generally horizontal position and a folded position, comprising:

(a) a frame comprising a body section, an intermediate cavity section, and a seat section;

(b) means pivotally interconnecting said frame sections for pivotal movement between said unfolded position wherein said body section, said cavity section, and said seat section are serially and horizontally aligned, and said folded position wherein said body and foot sections are generally horizontal, said seat section overlies said body section, and said cavity section extends substantially vertically between said body and foot sections; and (c) a mattress carried by said frame and movable therewith between the unfolded and folded positions, said mattress comprising a body section overlying said body section of said frame, a cavity section overlying said cavity section of said frame, and a seat section overlying said seat section of said frame, wherein said sections of said mattress are of uniform depth in the unfolded position, and wherein said cavity and seat sections of said mattress are collapsible in the depth dimension when said bed in is the folded position, and said body section of said mattress is noncollapsible in the depth dimension.

22. The foldable bed as defined in claim 21 wherein said frame further comprises a head section pivotally mounted to said body section on the side thereof opposite said cavity section of said frame, said interconnecting means further comprises means for pivoting said head section about said body section between a horizontal position when said bed is in the folded position and a generally upright position when said bed is in the folded position, and said mattress further comprises a collapsible head section pivotally interconnected to said body section of said mattress that overlies said head section of said frame, and which is collapsible in the depth dimension when said bed is in the folded position.

23. A foldable bed movable between an unfolded extended and generally horizontal position, and a folded position, and comprising:

(a) a frame comprising a head section, a body section, a cavity section, and a seat section;

(b) means pivotally interconnecting said frame sections for pivotal movement between the unfolded position, wherein said head section, said body section, said cavity section, and said seat section are serially and horizontally aligned, and the folded position, wherein said body and seat sections are generally horizontal, said foot section overlies said body section, said cavity section extends substantially vertically between said body and seat sections, and said head section is substantially upright; and (c) linkage means mounting said head section for movement between a horizontal position and an inclined position when said bed is in the unfolded position, and for releasably locking said head section in the inclined position, comprising:

(i) a mounting linkage connected to said frame;

(ii) a locking member pivotally connected through its center to said mounting linkage having a pair of concave arcuate edges on opposing sides of said pivot and a pair of notched edges on the opposing sides of said pivot perpendicular to those of said concave arcuate edges;

(iii) a latching link pivotally connected to said mounting linkage which includes a C-shaped portion, said C-shaped portion having a hooking arm on its end opposite said pivotal connection for rotating said locking member and a retaining edge facing said hooking arm, and a convex arcuate camming edge disposed in the same direction as the hooking arm; and (iv) means for rotating said latching link.

24. A foldable bed as defined in claim 23, wherein said means for rotating said latching link comprises a driving link pivotally connected to said head section and pivotally connected to said latching link at the end thereof opposite said C-shaped portion.

25. A foldable bed movable between an unfolded extended and generally horizontal position and a folded position which comprises:

(a) a frame comprising a body section, an intermediate cavity section, and a seat section, said body section comprising a pair of laterally spaced apart side rails and a body section support assembly mounted between said side rails;

(b) means pivotally interconnecting said frame sections for pivotal movement between the unfolded position and the folded position, wherein in the unfolded position said body section, said cavity section, and said seat section are serially and horizontally aligned, and the folded position wherein said body and seat sections are generally horizontal and said seat section overlies said body section and wherein said cavity section extends substantially vertically between said body and seat sections; and (c) means mounting said body section support assembly for movement between a raised position in horizontal alignment with said other sections when said bed is in the unfolded position and a lowered position below said raised position when said bed is in the folded position, and means for causing said body section support assembly to move between said raised and lowered positions when the bed is moved between the unfolded and folded positions.

26. A foldable bed as defined in claim 25 wherein said means for mounting said body section support assembly includes a pair of lowering members, each of which is pivotally connected and responsive to movement of one of said pair of side rails of said cavity section and further attached to said body section support assembly, wherein as said bed moves from the folded position to the unfolded position, the rotation of said lowering members causes said body section support assembly to rise and translate toward the end of said body section connected to said cavity section.

27. A foldable bed movable between an unfolded extended and generally horizontal position and a folded position which comprises:

(a) a frame comprising a body section, an intermediate cavity section, and a seat section, (b) means pivotally interconnecting said frame sections for pivotal movement between the unfolded position, wherein in the unfolded position said body section, said cavity section, and said seat section are serially and horizontally aligned, and the folded position, wherein said body and seat sections are generally horizontal, said seat section overlies said body section, and said cavity section extends substantially upright between said body and seat sections; and (c) means for causing said cavity section and said seat section of said frame to assume a first intermediate position between the unfolded position and a second generally vertical intermediate position, and for biasing said cavity section and said seat section of said frame toward the first intermediate position when said bed is in either the unfolded position or the second intermediate position.

28. A foldable bed as defined in claim 27 wherein said means for causing said cavity section and said seat section to assume a first intermediate position comprises a torsion bar having a cavity segment, a torsion segment, and a body segment, said cavity segment being perpendicularly attached at one end to said torsion segment and fixed at its other end to said cavity section, and said body segment being attached to said torsion segment on the end thereof opposite said cavity segment perpendicularly to said torsion segment and attached at its other end to said body section, wherein said cavity segment extends from said torsion segment within the plane defined by said side rails of said seat section in the second intermediate position and the plane defined by said side rails of said seat section in the unfolded position.

29. The foldable bed defined in claim 28 wherein the angle formed by said body segment and said cavity segment when said torsion bar is viewed along the longitudinal axis of said torsional segment is between about 110 and 160 degrees.

30. A foldable bed frame suitable for use in a foldable sofa bed comprising:

(a) an outer frame comprising a head section, a body section, an cavity section, a seat section, and a foot section, with each section including a pair of laterally spaced apart side rails, and (b) means pivotally interconnecting said frame sections for pivotal movement between the unfolded position and the folded position, wherein in the unfolded position, said head section, said body section, said cavity section, said seat section, and said foot section are serially and horizontally aligned, and in the folded position, said body and foot sections are generally horizontal, said seat and foot sections overly said body section, said cavity section extends substantially vertically between said body and seat sections, said head section is substantially upright, and the substantial majority of the lengths of said side rails of said seat and foot sections lie below a plane extending from the uppermost end of the cavity section to the end of the foot section opposite the seat section.

31. The foldable bed frame defined in claim 30 wherein said bed further comprises a foot section leg assembly pivotally connected to said foot section and said seat section for supporting said frame beneath said foot section in the unfolded position, said foot section leg assembly comprising a foot section control link and a leg member pivotally connected to said foot section control link.

32. The foldable bed frame defined in claim 31 wherein said interconnecting means comprises:

(a) foot section interconnecting means for pivoting said foot section pivotally interconnected to said leg member;

(b) seat section interconnecting means for pivoting said seat section operatively interconnected to said foot section interconnecting means; and (c) cavity section interconnecting means for pivoting said cavity section pivotally interconnected to said seat section interconnecting means.

33. The foldable bed frame as defined in claim 32 wherein said foot section interconnecting means for pivoting said foot section comprises:

(i) said foot section control link pivotally interconnected to said foot section;

(ii) an extension arm fixed to said seat section on the end thereof opposite said cavity section and pivotally interconnected to said leg member; and (iii) said leg member pivotally interconnected to said foot section control link;

and wherein said seat section interconnecting means comprises:

(iv) said leg member; and (v) a cavity pivot link having a longer angled arm, a shorter arm attached to said longer arm, and a vertex at the attachment therebetween, said cavity pivot link being pivotally connected at said vertex to said cavity section and said longer angled arm being pivotally connected to said leg member of said foot support assembly;

and wherein said cavity interconnecting means comprises:

(vi) said shorter arm of said cavity pivot link; and (vii) a cavity drawing link pivotally interconnected to said seat section on one end and to said shorter arm of said pivot link on the other end.

34. A foldable bed movable between an unfolded extended and generally horizontal position, and a folded position, which comprises:

(a) a frame comprising a body section, an intermediate cavity section, and a seat section, with each section comprising a pair of laterally spaced apart side rails, (b) means pivotally interconnecting said frame sections for pivotal movement between the unfolded position and the folded position, wherein in the unfolded position said body section, said cavity section, and said seat section are serially and horizontally aligned, and the folded position, wherein said body and seat sections are generally horizontal, said seat section overlies said body section, and said cavity section extends substantially upright between said body and seat sections, said interconnecting means including cavity interconnection means, said cavity interconnection means comprising:

(i) a cavity drawing link pivotally interconnected to said cavity section and attached to said body section so that said cavity drawing link is forwardly and rearwardly unconstrained when said bed is in the unfolded position, and (ii) means for controlling the pivotal movement of said cavity drawing link about said body section responsive to the pivotal movement of the seat section about the cavity section;

so that said seat section pivots about said cavity section toward the folded position simultaneously with the pivoting of said cavity section about said body section toward the folded position, thereby preventing reverse pivotal movement of said seat section about said cavity section.

35. The foldable bed as defined in claim 34, wherein said cavity drawing pivot link is pivotally connected to said cavity section and slidably and pivotally connected to said seat section, said pivot member having a cammed edge intermediate of said pivotal connections;

and wherein said means for controlling the movement of said cavity drawing link comprises stationary stop means fixedly attached relative to said body section and in contacting relation with said cammed edge in the folded position; wherein as said bed moves from the unfolded position to the folded position, said cavity drawing member rotates about said pivotal connection with said body section and translates along said slidable connection toward aid cavity section, the translational and rotational movement of said member being controlled by movement of said cammed edge along said stationary stop means.

36. A foldable bed movable between an unfolded extended and generally horizontal position, and a folded position, which comprises:

(a) a frame comprising a body section, an intermediate cavity section, and a seat section, with each section comprising a pair of laterally spaced apart side rails, (b) means pivotally interconnecting said frame sections for pivotal movement between the unfolded position and the folded position, wherein in the unfolded position said body section, said cavity section, and said seat section are serially and horizontally aligned, and the folded position, wherein said body and seat sections are generally horizontal, said seat section overlies said body section, said cavity section extends substantially upright between said body and seat sections; and (c) means for locking said bed into the folded position comprising:

(i) a leg assembly pivotally interconnected with said seat section movable between a folded condition and an unfolded condition;

(ii) a first locking means for restraining pivotal movement of said seat section about said cavity section when said bed is in the folded position, said first locking means being responsive to the pivotal movement of said leg member, and being pivotally interconnected to said seat section;

(iii) a second locking means for restraining pivotal movement of said seat section about said cavity section when said bed is in the folded position, said second locking means being responsive to the movement of said first locking means and being pivotally interconnected to said seat section and said cavity section; and (iv) a third locking means for restraining pivotal movement of said cavity section about said body section when said bed is in the folded position, said third locking means being responsive to the movement of said second locking means and being pivotally interconnected to said cavity section and said body section;

wherein when the bed is in the folded position, movement of said leg assembly into its folded condition causes said first locking means and said second locking means to restrain the pivotal movement of said seat section about said cavity section and said third locking means to restrain the pivotal movement of said cavity section about said body section.

37. The foldable bed as defined in claim 36, wherein said leg assembly comprises:

(a) a leg member; and (b) a pivot member pivotally interconnected to said seat section having a longer arm and a shorter arm, said shorter arm being pivotally connected to said second locking unit and said longer arm being pivotally interconnected to said leg member;

and wherein said first locking means comprises:

(c) a leg control link pivotally interconnected at one end to said seat section and pivotally interconnected at its other end to said leg member;

and wherein said second locking means comprises:

(d) said shorter arm of said seat pivot member; and (e) a cavity pivot link pivotally interconnected to said shorter arm of said seat pivot member, pivotally interconnected to said cavity section, and operably interconnected to said third locking means;

wherein in the folded position the pivots of said leg member about said longer arm of said seat pivot member, said leg control link about said leg member, and said leg control link about said seat section are substantially linearly aligned, and the pivots of said seat pivot member about said seat section, said shorter arm of said seat pivot member about said seat section, and said longer arm of said cavity pivot member about said cavity section are substantially linearly aligned.

38. A subassembly useful in the construction of a foldable bed frame movable between a folded position and an unfolded position, comprising:

(a) a frame subunit comprising a cavity section, a seat section, and a foot section, with each section including a pair of side rails; and (b) means pivotally interconnecting said foot section to said seat section, said seat section to said cavity section, and said cavity section to the body section of the frame;

wherein said interconnecting means are constructed and arranged such that in the unfolded position said cavity section, said seat section, and said foot section are serially and horizontally aligned, and in the folded position, said seat section is generally horizontal and inverted, said cavity section extends substantially vertically beneath said seat section, and the substantial majority of the lengths of said side rails of said seat section and said foot section lie below a plane extending from the uppermost end of the cavity section to the end of the foot section opposite the seat section.

39. The subassembly defined in claim 38 which further comprises a foot section leg assembly pivotally connected to said foot section and said seat section for supporting said frame beneath said foot section in the unfolded position, said foot section leg assembly comprising a foot section control link and a leg member pivotally connected to said foot section control link.

40. The subassembly defined in claim 39 wherein said interconnecting means comprises:

(a) foot section interconnecting means for pivoting said foot section pivotally interconnected to said leg member;

(b) seat section interconnecting means for pivoting said seat section operatively interconnected to said foot section interconnecting means; and (c) cavity section interconnecting means for pivoting said cavity section pivotally interconnected to said seat section interconnecting means.

41. The subassembly as defined in claim 40 wherein said foot section interconnecting means for pivoting said foot section comprises:

(i) said foot section control link pivotally interconnected to said foot section;

(ii) an extension arm fixed to said seat section on the end thereof opposite said cavity section and pivotally interconnected to said leg member; and (iii) said leg member pivotally interconnected to said foot section control link; and wherein said seat section interconnecting means comprises:

(iv) said leg member; and (v) a cavity pivot link having a longer angled arm, a shorter arm attached to said longer arm, and a vertex at the attachment therebetween, said cavity pivot link being pivotally connected at said vertex to said cavity section and said longer angled arm being pivotally connected to said leg member of said foot support assembly;

and wherein said cavity interconnecting means comprises:

(vi) said shorter arm of said cavity pivot link; and (vii) a cavity drawing link pivotally interconnected to said seat section on one end and to said shorter arm of said pivot link on the other end.

42. A mattress foldable into a folded and an unfolded position comprising at least one collapsible section and a noncollapsible section wherein in the unfolded position, said at least one collapsible section and said noncollapsible section are pivotally interconnected and horizontally and serially aligned and of uniform depth, and in the folded position, said at least one collapsible section is collapsed in the depth dimension and overlies said noncollapsible section.

43. A mattress defined in claim 42 wherein said noncollapsible section comprises a body section, and said at least one collapsible section comprises a cavity section pivotally interconnected to said body section on one end, and a seat section connected to said cavity section on the end thereof opposite said body section, and wherein in the folded position, said body and seat sections are generally horizontal, said seat section overlies said body section, and said cavity section extends substantially vertically between said body and seat sections, with said cavity section and seat sections of said mattress each being collapsed in the depth dimension.

44. A mattress as defined in claim 43 which further comprises a head section pivotally mounted to said body section on the side thereof opposite said cavity section, said head section being fully extended in the depth dimension and horizontally aligned with said other sections in the unfolded position, and being collapsible in the depth dimension and disposed substantially upright in the folded position.

45. A mattress as defined in claim 44 which further comprises a foot section pivotally mounted to said seat section on the side thereof opposite said cavity section, said foot section being fully extended in the depth dimension and horizontally aligned with said other sections in the unfolded position, and being collapsible in the depth dimension and disposed substantially upright immediately adjacent said head section in the folded position.

46. A mattress as defined in claim 43 which further comprises a foot section pivotally mounted to said seat section the side thereof opposite said cavity section, said foot section being fully extended in the depth dimension and horizontally aligned with said other sections in the unfolded position, and being collapsible in the depth dimension and disposed substantially upright in the folded position.

47. A mattress as defined in claim 42 wherein said noncollapsible section includes:

(a) a wire frame defining the periphery of said body section and having an upper and a lower surface comprising a plurality of wires extending the width of said mattress; and (b) noncollapsible helical springs fixed at either end to said upper surface and said lower surface of said frame; and wherein said collapsible sections each include:

(c) a wire frame defining the periphery of said sections and having an upper and a lower surface comprising a plurality of wires extending the length of said mattress, each of said wires having means for pivotal interconnection with collapsible springs;

(d) a plurality of collapsible springs, each comprising a M-shaped wire, each of the vertices of said wire having a tight circular coil, the circle of said coils being disposed in the same plane as said legs, and each of the legs of said springs having attachment means adapted to pivot about said pivotal interconnection means of said mattress wires;

so that as the frame moves to the folded position from the unfolded position, said upper surfaces of said cavity, seat, and foot sections translate along the length dimension of the bed relative to their corresponding lower surfaces, and thereby cause these sections to collapse in the depth dimension.

* * * * *